US012630277B1

(12) United States Patent
Pelini

(10) Patent No.: US 12,630,277 B1
(45) Date of Patent: May 19, 2026

(54) PARALLELOGRAM JACK PLATE

(71) Applicant: Mark Pelini, Valrico, FL (US)

(72) Inventor: Mark Pelini, Valrico, FL (US)

( * ) Notice: Subject to any disclaimer, the term of this patent is extended or adjusted under 35 U.S.C. 154(b) by 355 days.

(21) Appl. No.: 18/423,476

(22) Filed: Jan. 26, 2024

(51) Int. Cl.
*B63H 20/10* (2006.01)

(52) U.S. Cl.
CPC ..... *B63H 20/10* (2013.01)

(58) Field of Classification Search
CPC ..... B63H 20/10
See application file for complete search history.

(56) References Cited

U.S. PATENT DOCUMENTS 4,890,811 A * 1/1990 Ehni ..... B63H 20/06 248/641
5,075,927 A 12/1991 Porta
6,409,556 B1 * 6/2002 Vance ..... B63H 20/106 248/641
6,890,227 B1 * 5/2005 Alby ..... B63H 20/106 440/61 R
7,513,810 B1 * 4/2009 Pelini ..... B63H 20/106 440/61 R
8,535,105 B1 * 9/2013 Pelini ..... B63H 20/02 440/61 E
10,220,925 B1 * 3/2019 Pelini ..... B63H 20/06

* cited by examiner

*Primary Examiner* — Richard M Camby
(74) *Attorney, Agent, or Firm* — Edward P. Dutkiewicz

(57) ABSTRACT

There are four rigid mounts. There are a plurality of bushings having helical fluting there in. There is a upper plate, a motor mount plate and a lower plate which coupled to an existing hull, form a parallelogram which is moved by a hydraulic cylinder. There is a sacrificial anode coupled to the lower plate. The top cap has at least one snap ring and at least one o-ring and is permanently fixed within the hydraulic cylinder interior surface once it is inserted into the hydraulic cylinder.

13 Claims, 21 Drawing Sheets

PARALLELOGRAM JACK PLATE

BACKGROUND OF THE INVENTION

Rule 1.78(F)(1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

There are no cross referenced or related applications which are direct to, or related to, the present application.

There is no research of development of this application which is federally sponsored.

Field of the Invention

The present invention relates to a parallelogram jack plate and more particularly pertains to a device for raising and lowering an outboard motor.

Description of the Prior Art

The use of motor raising devices, known as jack plates, is known in the prior art. More specifically, motor raising devices, previously devised and utilized for the purpose of raising and lowering outboard motors are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe a parallelogram jack plate that allows a device for raising and lowering an outboard motor comprising the parts herein described.

In this respect, the parallelogram jack plate according to the present invention substantially departs from the conventional concepts and designs of the prior art, and in doing so provides an apparatus primarily developed for the purpose of a device for raising and lowering an outboard motor.

Therefore, it can be appreciated that there exists a continuing need for a new and improved parallelogram jack plate which can be used for raising and lowering an outboard motor while keeping the orientation of the outboard motor, to the boat hull, constant. In this regard, the present invention substantially fulfills this need.

SUMMARY OF THE INVENTION

In view of the foregoing disadvantages inherent in the known types of motor raising devices, now present in the prior art, the present invention provides an improved parallelogram jack plate. As such, the general purpose of the present invention, which will be described subsequently in greater detail, is to provide a new and improved parallelogram jack plate which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

In describing aspects of the invention, the word "generally" may be used. The term, "generally" when used to describe a configuration means that the configuration includes those aspects which are within normal manufacturing parameters of acceptance. By way of example, the term "generally round" may be used. This should be interpreted to mean that the configuration may be perfectly round, but may also have a radius which is not exact, but is within the manufacturing parameters. For example, a basketball may be generally round, but not be perfectly round.

By adjacent to a structure is meant that the location is near the identified structure.

To attain this, the present invention essentially comprises a parallelogram jack plate, comprising several components, in combination.

There are four rigid mounts, being an upper transom mount, a lower transom mount, a lower distal mount, and an upper distal mount. Each of the four mounts have a proximal surface and a distal surface, with a thickness there between. Each of the four mounts have a first end and a second end, with a length there between. The length of the preferred embodiment of the four rigid mounts is 14.25 inches.

Each of the four mounts first end and each of the four rigid mounts second end each having a grease passageway there into and a plurality of threaded bolt holes there into. Each of the four mounts have an upper flange and a lower flange, with a length there between. In the preferred embodiment the combined length of the upper flange and the lower flange is 2.593 inches.

The upper flange and the lower flange each have a plurality of bolt holes there through. Each proximal surface of each of the four rigid mounts has an open hinged portion. The open hinged portion of each of the four rigid mounts has a curved hook portion having a bushing seat. In the preferred embodiment the open hinged portion of each of the four rigid mounts has a radius of curvature of 1.10 inches.

Each of the four rigid mount open hinged portion has an internal surface and an external surface. The internal surface of each of the four rigid mounts has open hinged portion having an outer stop and an inner stop, with a curved surface there between, forming the bushing seat.

The rounded hook portion of each of the four rigid mounts have a distal enlargement and an internal recess, with the internal recess being located between the distal enlargement and the rounded hook portion of each of the four rigid mounts. The rounded hook portion of the first end and the second end of each of the four rigid mounts has a threaded bolt hole there into.

There are four rigid mount bushings. Each rigid mount bushing has a rectilinear configuration, with an inner surface and an outer surface with a thickness there between. In the preferred embodiment, the thickness of the four rigid mount bushings is 0.10 inch.

Each of the rigid mount bushings has a first end and a second end, with a length there between. In the preferred embodiment, the length of each of the rigid mount bushings is 14.25 inches. The inner surface of each of the rigid mount bushings has a helical fluting therein, running the length of each of the rigid mount bushings. In the preferred embodiment the intersecting distance of the helical fluting is between 3.50 inches and 4.50 inches.

There is a pair of long internal hinges, being an upper proximal internal long hinge and a lower distal internal long hinge. The upper proximal internal long hinge and the lower distal internal long hinge each have a rectilinear configuration with an upper surface and a lower surface with a thickness there between. The upper proximal internal long hinge and the lower distal internal long hinge each having a hook shaped configuration with a proximal portion and a distal portion with a length there between.

The distal portion of each of the pair of internal long hinges each have a rectilinear configuration with a plurality of bolt holes there through. The proximal portion of each of the internal long hinges each have a curved configuration forming the hook configuration.

The pair of internal long hinges each have a top surface, a bottom surface, a right side edge, a left side edge, a distal edge, and a proximal edge.

Each of the hooks of the pair of internal long hinges have a curved external surface and a curved internal surface. The curved internal surface of the proximal portion of each of the pair of internal long hinges have an proximal stop and a distal stop, with a curved surface there between, forming a long internal hinge bushing seat.

There is a pair of long internal hinge bushings with each of the long internal hinge bushings having a rectilinear configuration, with an inner surface and an outer surface with a thickness there between. Each of the long internal hinge bushings have a first end and a second end with a length there between. The inner surface of each of the long internal hinge bushings have a helical fluting therein running the length of each of the long internal hinge bushings. In the preferred embodiment, the intersecting distance of the helical fluting is between 3.50 inches and 4.50 inches.

There is a pair of internal short hinge assemblies, being a distal upper internal short hinge assembly and a proximal lower internal short hinge assembly. Each of the short hinge assemblies have a right side internal short hinge, a left side internal short hinge, and a middle internal short hinge.

Each of the right side internal short hinges and each of the left side internal short hinges have a distal portion having a rectilinear configuration. The distal portion of the each of the right side internal short hinges and each of the left side internal short hinges have an upper surface and a lower surface, with a thickness there between. The distal portion of the each of the right side internal short hinges and each of the left side internal short hinges have a plurality of bolt holes there through. Each of the right side internal short hinges and each of the left side internal short hinges have a proximal portion.

The proximal portion of each of the right side internal short hinges and each of the left side internal short hinges have a hook shaped configuration, with a proximal hook portion and a distal hook portion, with a length there between. Each of the right side internal short hinges and each of the left side internal short hinges have a proximal stop and a distal stop with a curved bushing surface there between.

There four short hinge bushings. Each of the short hinge bushings have a rectilinear configuration, with an inner surface and an outer surface with a thickness there between. Each of the short hinge bushings have a first end and a second end, with a length there between. The inner surface of each of the short hinge bushings having a helical fluting therein running the length of each of the long internal hinge bushings. In the preferred embodiment the four short hinge bushings, which are coupled to the right side internal short hinge and the left side internal short hinge, have a length of 4.0 inches.

The two middle internal short hinges, of each of the internal short hinge assemblies, have a proximal portion having a rectilinear configuration with an upper surface and a lower surface with a thickness there between. The proximal portion of each of the internal short hinge assemblies middle short hinge having a bottom cap mounting bolt hole there through, with an associated bottom cap mounting bolt.

The distal portion of each of the middle short hinges of the pair of internal short hinge assemblies have a hook shaped configuration, with an upper surface, a lower surface, and a thickness there between. Each of the pair of internal hinge assemblies middle hinge hook shaped configuration have a proximal hook portion and a distal hook portion, with a length there between. Each of the pair of internal short hinge assemblies middle short hinge have a proximal stop and a distal stop with a curved bushing surface there between.

There is a pair of middle internal short hinge bushings. Each of the middle internal short hinge bushings have a rectilinear configuration, with an inner surface and an outer surface with a thickness there between. Each of the middle internal short hinge bushings have a first end and a second end, with a length there between. The inner surface of each of the middle internal short hinge bushings have a helical fluting therein running the length of each of the middle internal short hinge bushings. In the preferred embodiment the pair of middle internal short hinge bushings, which are coupled to each of the middle internal short hinges, have a length of 5.5 inches.

There is a lower plate having a rectilinear configuration with an upper surface and a lower surface, with a thickness there between. The lower plate has a proximal portion, a distal portion, a right side portion, a left side portion, and a central portion. The distal portion of the lower plate has a plurality of bolt holes there through, with associated bolts. In the preferred embodiment, the lower plate has a length 18.37 inches and a width of 15.0 inches.

The proximal portion of the lower plate has a plurality of proximal lower internal short hinge assembly bolt holes there through with a plurality of associated lower internal short hinge assembly bolts. The proximal portion of the lower plate is coupled to the distal portion of the proximal lower internal short hinge assembly right side short hinge and to the distal portion of the proximal lower internal short hinge assembly left side short hinge, by the associated bolts of the proximal portion of the lower plate.

There is a sacrificial anode which has a rounded configuration with a central hole there through. The sacrificial anode is removably coupled to the lower surface of the lower plate. The sacrificial anode has a diameter of 1.969 inches, with a central hole having a diameter of 0.256 inches There is an upper plate. The upper plate has a rectilinear configuration with an upper surface and a lower surface, with a thickness there between. The upper plate has a proximal portion, a distal portion, a right side portion, a left side portion, and a central portion. The central portion has a plurality of taper shaped holes there through.

The distal portion of the upper plate has a plurality of internal short hinge bolt holes there through.

The proximal portion of the upper plate has a plurality of flange bolt holes there through, with each flange bolt hole having an associated upper plate flange bolt. The proximal portion of the upper plate has the upper internal right side short hinge, and upper internal left side short hinge, coupled thereto by the associated bolts of the proximal portion of the upper plate.

The distal portion of the right side internal short hinge and the distal portion of the left side lower internal hinge are coupled to the upper plate distal portion, using the upper internal hinge mounting hole associated bolts.

The upper proximal internal long hinge is coupled to the proximal portion of the upper plate by the associated bolts. The upper proximal internal long hinge is rotatably coupled to the upper transom mount distal surface open hinged portion with the proximal hook shaped portion of the upper internal long hinge being mated with and received by the upper hinged portion of the upper transom mount. In the preferred embodiment, the upper plate has a length of 14.0 inches and a width of 15.0 inches.

There is a motor mount plate. The motor mount plate has a proximal surface and a distal surface, with a thickness there between. The motor mount plate has a top edge and a bottom edge, with a length there between. The motor mount plate has a right side edge and a left side edge, with a thickness there between. The motor mount plate has a top portion adjacent to the top edge and a bottom portion adjacent to the bottom edge.

The top portion of the motor mount plate has a plurality of upper distal rigid mount bolt holes there through, with a plurality of associated upper distal rigid mount bolts.

The bottom portion of the motor mount plate has a plurality of lower distal rigid mount bolt holes there through, with a plurality of associated lower distal rigid mount bolts.

The top portion of the motor mount plate is coupled to the upper distal rigid mount. The bottom portion of the motor mount plate is coupled to the lower distal rigid mount. The upper distal short hinge assembly is rotatably coupled to the upper distal rigid mount. The lower distal internal long hinge is coupled to the bottom portion of the motor mount plate. The lower distal internal long hinge is rotatably coupled to the lower distal mount. In the preferred embodiment, the motor mount plate has a length of 17.0 inches and a width of 15.0 inches.

There is a pair of accessory mounting plates having an L-shaped configuration. Each of the pair of accessory mounting plates have bolt holes there through. Each of the accessory mounting plates is removably coupled to the motor mount plate.

There is a bi directional hydraulic cylinder, herein referred to as the hydraulic cylinder. The hydraulic cylinder has an upper end and a lower end, with a length there between. The length of the hydraulic cylinder has a centrally located piston passageway there through. The piston passageway runs from the upper end of the hydraulic cylinder to the lower end of the hydraulic cylinder.

The hydraulic cylinder upper end piston passageway has at least one snap ring groove therein. The hydraulic cylinder has an associated ram, with the ram having an upper end and a lower end.

The hydraulic cylinder has a bottom cap and a top cap. The hydraulic cylinder lower end has the bottom cap, with the bottom cap having a plurality of circumferential recesses therein. The hydraulic cylinder bottom cap has a slot running from a median portion to a bottom end. The hydraulic cylinder bottom cap has a pin hole running through the median portion, with the pin hole being orthogonal to the slot. The bottom cap pin hole running across the slot. The bottom cap pin hole has an associated pin. In the preferred embodiment, the bottom cap has a diameter of 2.0 inches and a height of 3.295 inches.

The slot is configured to receive and mate with the proximal portion of one of the internal short hinge assemblies middle short hinges, with the bottom cap mounting bolt coupling the proximal lower internal short hinge assembly middle short hinge to the bottom cap of the hydraulic cylinder. In the preferred embodiment, the bottom cap slot has a width of 0.5 inches and a height of 1.795 inches.

The hydraulic cylinder ram upper end has an associated top shaft cap. The hydraulic cylinder ram upper end top shaft cap has a trapazoidal configuration, with an upper extent, a lower extent, and two sides there between. The upper extent has a slot there in.

The lower extent of the top shaft cap has a round recess therein, so as to mate with and receive the hydraulic cylinder ram upper end. The ram upper end top shaft cap upper extent is configured to mate with and receive the proximal portion of a middle internal short hinge of one of the internal short hinge assemblies. The associated lower cap mounting bolt is used to couple the proximal portion of one of the internal short hinge assemblies middle short hinge to the upper end of the ram upper end top shaft cap.

The hydraulic cylinder upper end has a top cap. The hydraulic cylinder upper end top cap has a cylindrical configuration, with a ram hole there through. The hydraulic cylinder upper end top cap has an smooth interior surface and an exterior surface. The hydraulic cylinder upper end top cap exterior surface has a plurality of grooves there in, with the hydraulic cylinder upper end top cap plurality of grooves having at least one snap ring and at least one o-ring. The top cap is configured to be permanently fixed within the hydraulic cylinder piston passageway once it is inserted into the centrally located piston passageway of the hydraulic cylinder.

There is a plurality of bracket caps. The bracket caps each have a curved upper edge and a flat lower edge. Each bracket cap has an inner surface and an outer surface, with a width there between. Each of the bracket caps has a plurality of bolt holes there through, with a plurality of associated bracket cap bolts. Each of the bracket caps have a grease fitting hole there through. Each grease fitting hole of each of the bracket caps has an associated grease fitting. In the preferred embodiment, the bracket caps each have a height of 3.323 inches and a width of 3.529 inches.

There is a plurality of backing plates. Each backing plate has a rectilinear configuration with a forward surface and a rearward surface, with a thickness there between. Each of the plurality of backing plates have a pair of bolt holes there through. The backing plates being used to reinforce attachment of the parallelogram jack plate to a hull of an existing boat. The backing plates are place on the inside of the existing hole, and the parallelogram jack plate is mounted on the outside of the existing boat hull.

Lastly, there is a hydraulic fluid source and hydraulic fluid source control, which is well known in the art and will not be discussed in any detail.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved parallelogram jack plate which has all of the advantages of the prior art motor raising devices, and none of the disadvantages.

It is another object of the present invention to provide a new and improved parallelogram jack plate which may be easily and efficiently manufactured and marketed.

It is further object of the present invention to provide a new and improved parallelogram jack plate which is of durable and reliable constructions.

An even further object of the present invention is to provide a new and improved parallelogram jack plate which is susceptible of a low cost of manufacture with regard to both materials and labor, and which accordingly is then susceptible of low prices of sale to the consuming public, thereby making such parallelogram jack plate economically available to the buying public.

Even still another object of the present invention is to provide a parallelogram jack plate for a device for raising and lowering an outboard motor.

Lastly, it is an object of the present invention to provide a new and improved parallelogram jack plate having four rigid mounts. There are a plurality of bushings having helical fluting there in. There is a upper plate, a motor mount plate and a lower plate which coupled to an existing hull, form a parallelogram which is moved by a hydraulic cylinder. There is a sacrificial anode coupled to the lower plate. The top cap has at least one snap ring and at least one o-ring and is permanently fixed within the hydraulic cylinder interior surface once it is inserted into the hydraulic cylinder.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
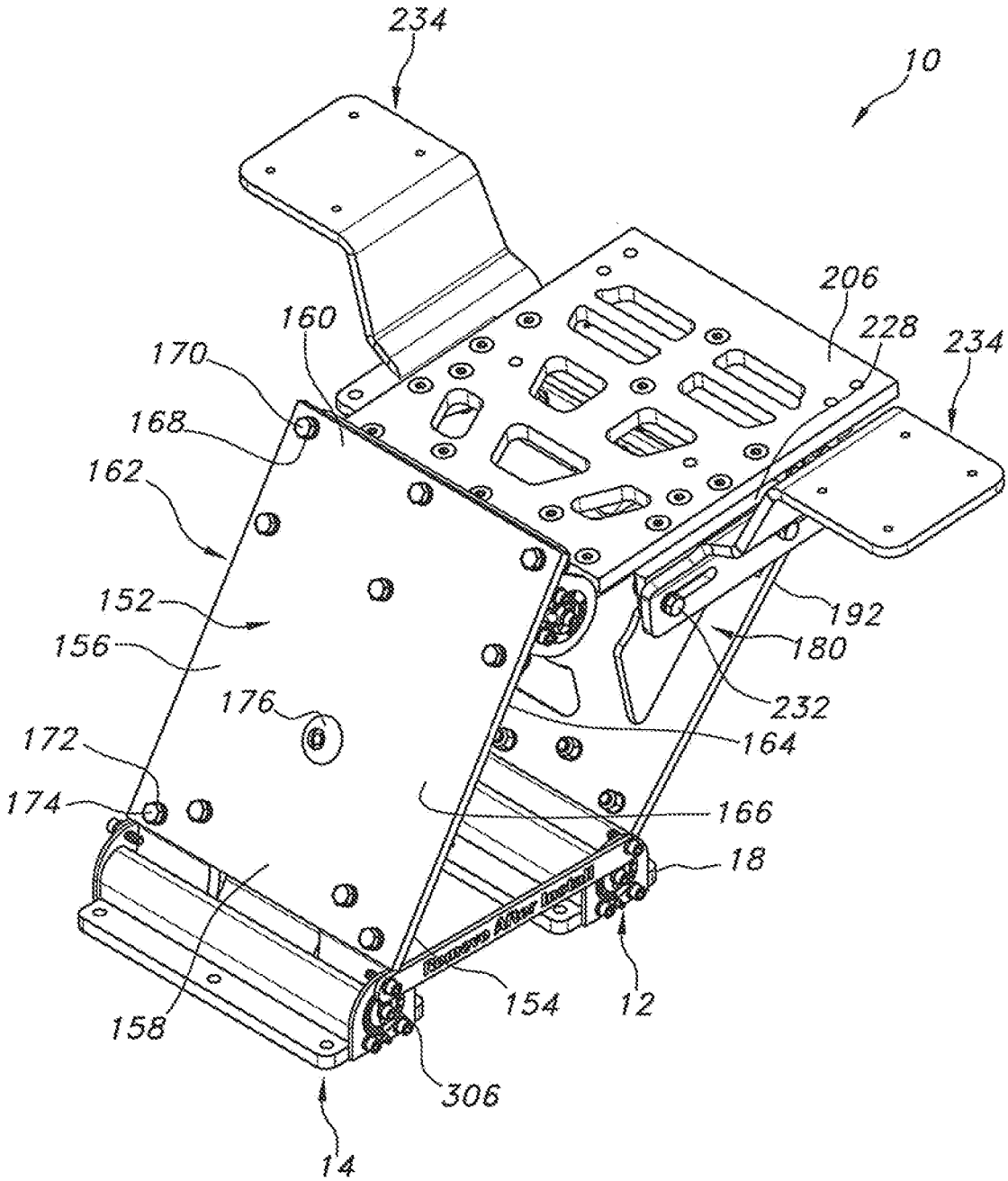
FIG. 1 is a perspective bottom left view of the parallelogram jack plate.
Figure 2:
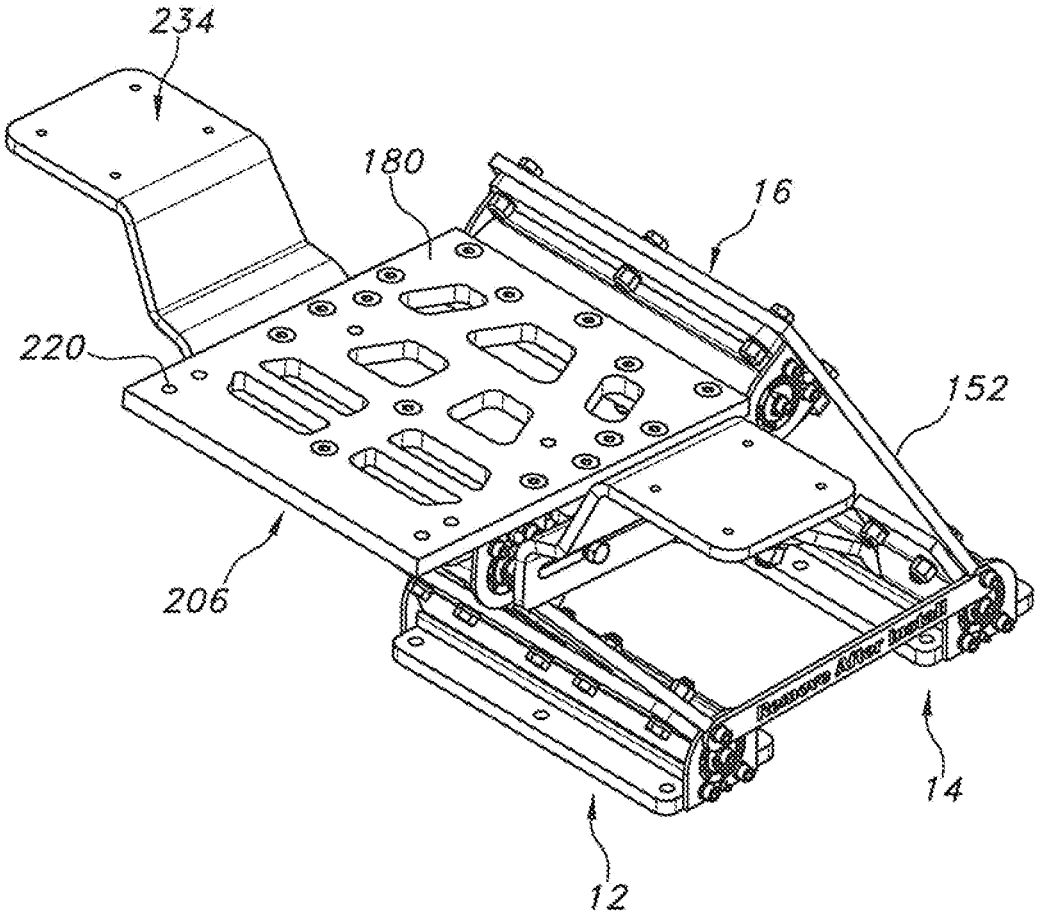
FIG. 2 is a perspective top right view of the invention.
Figure 3:
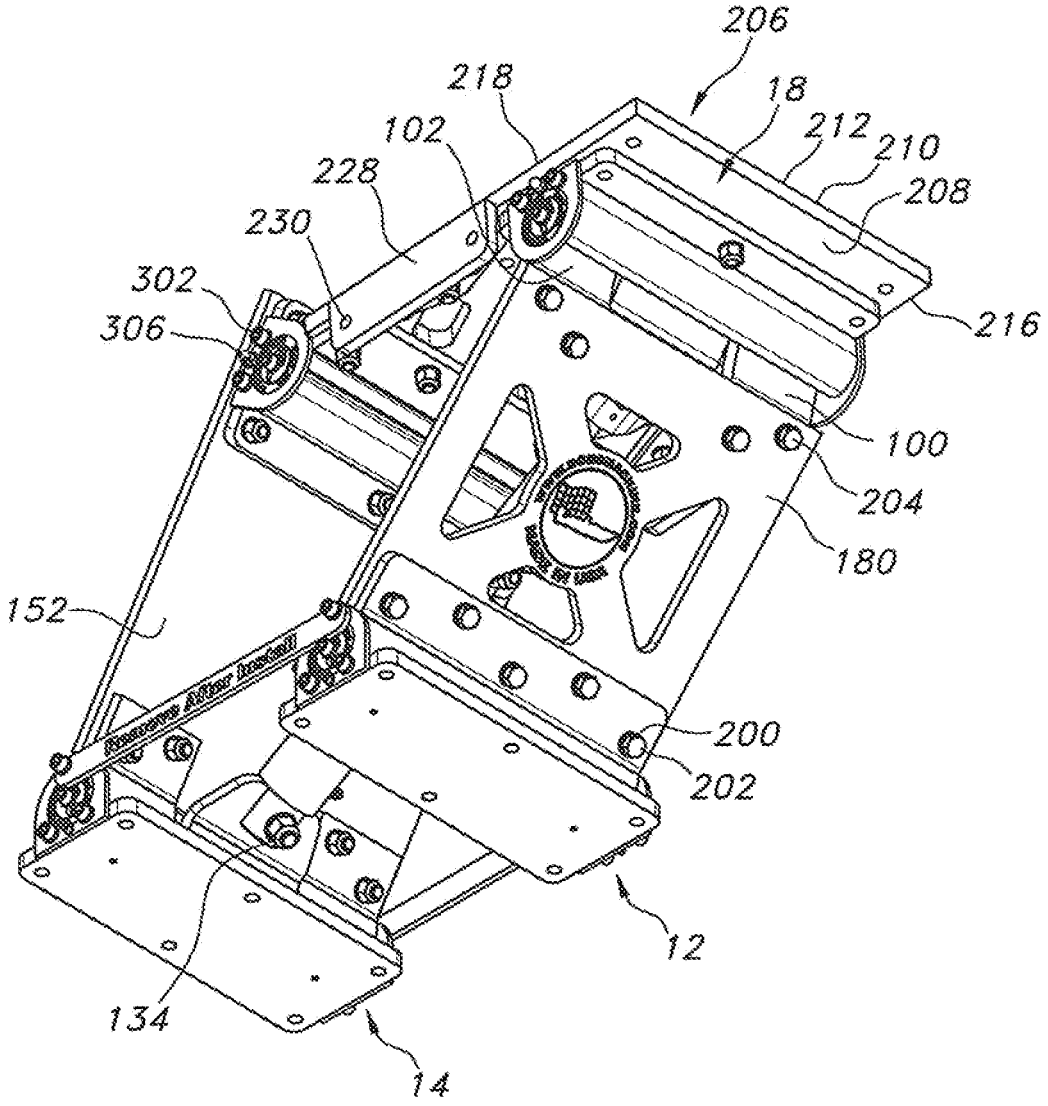
FIG. 3 is a perspective front right top view thereof.
Figure 4:
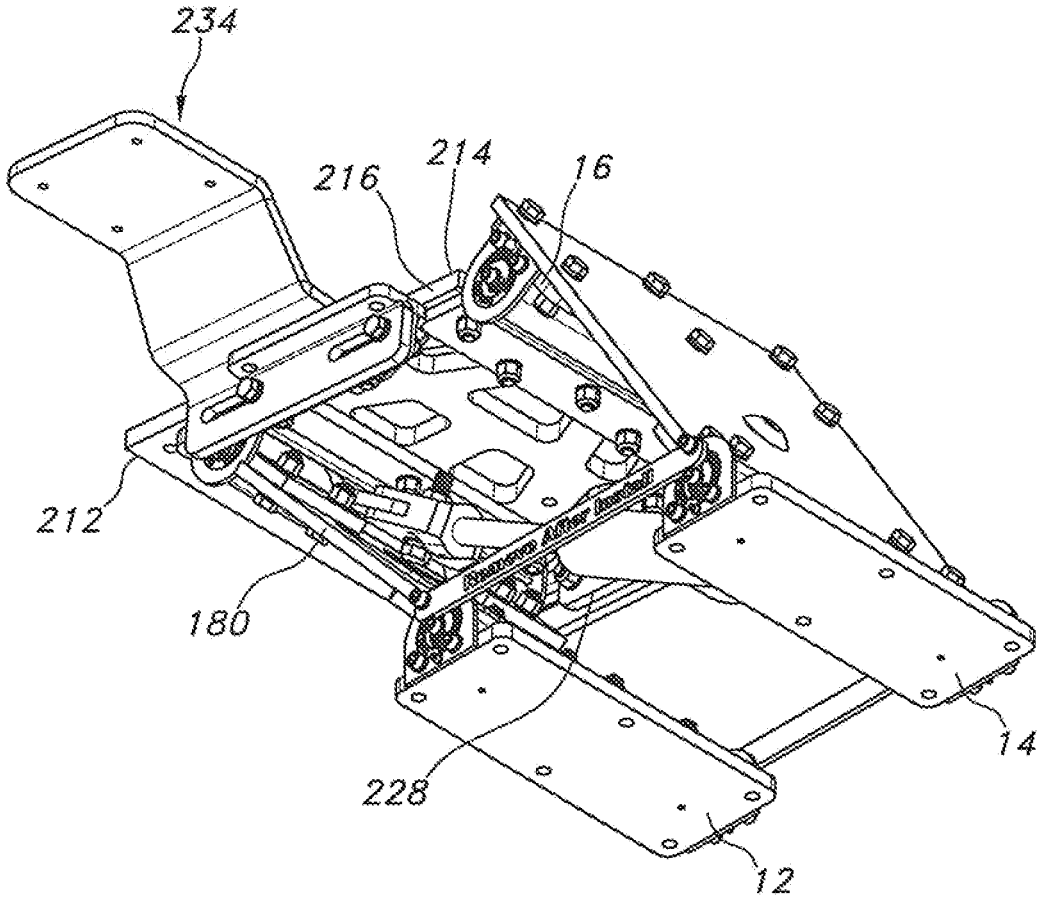
FIG. 4 is a perspective front bottom right view thereof.
Figure 5:
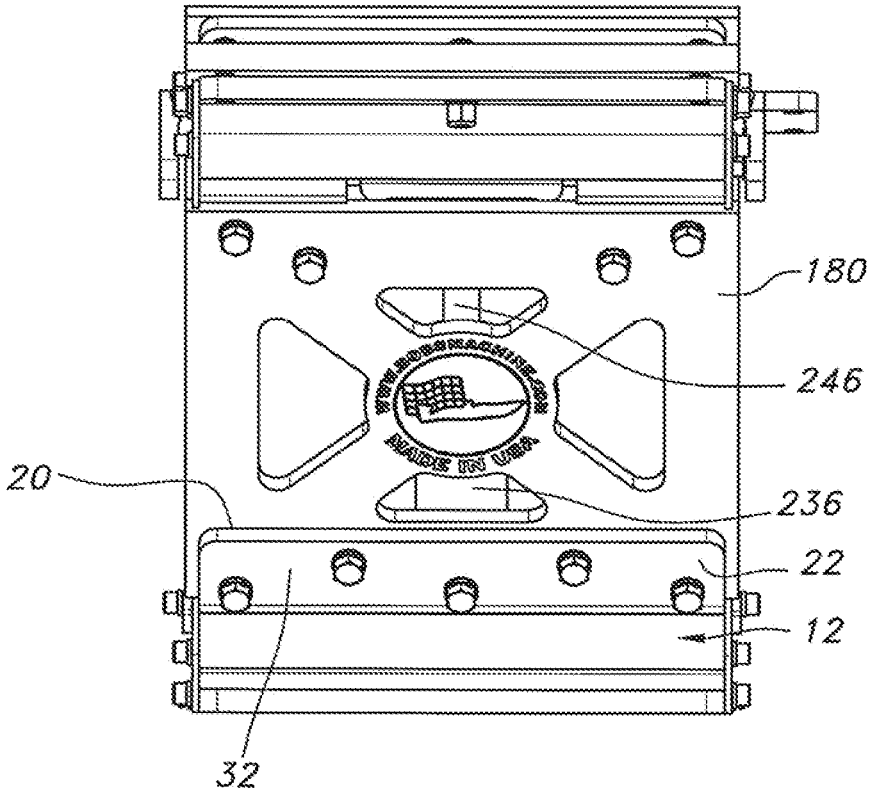
FIG. 5 is a top plan view thereof.
Figure 6:
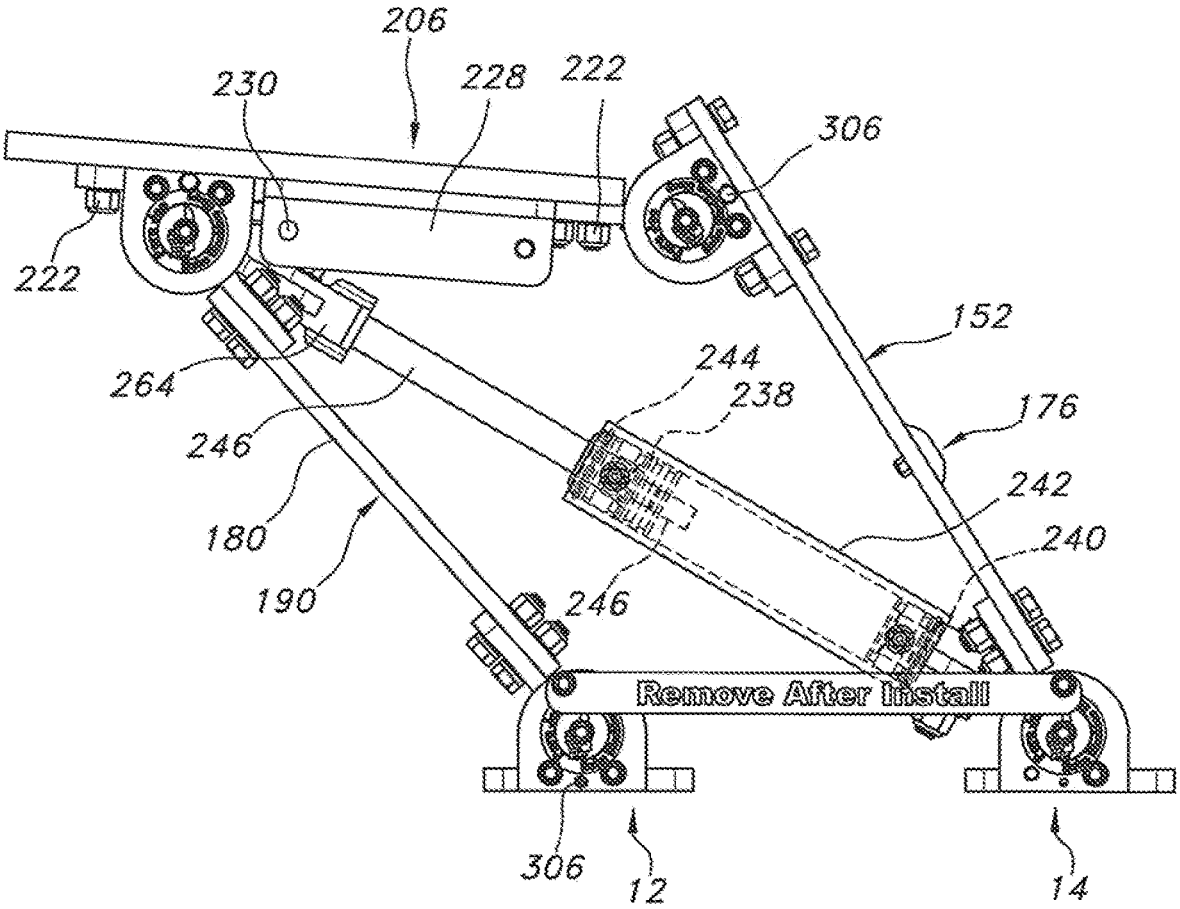
FIG. 6 is a right side elevational view thereof.
Figure 7:
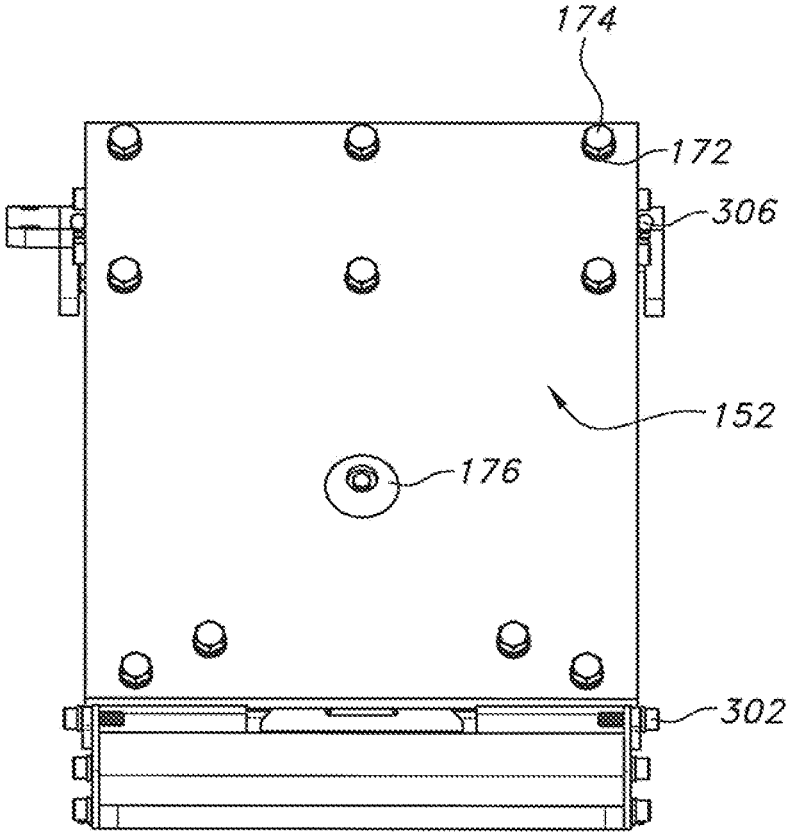
FIG. 7 is a bottom plan view thereof.
Figure 8:
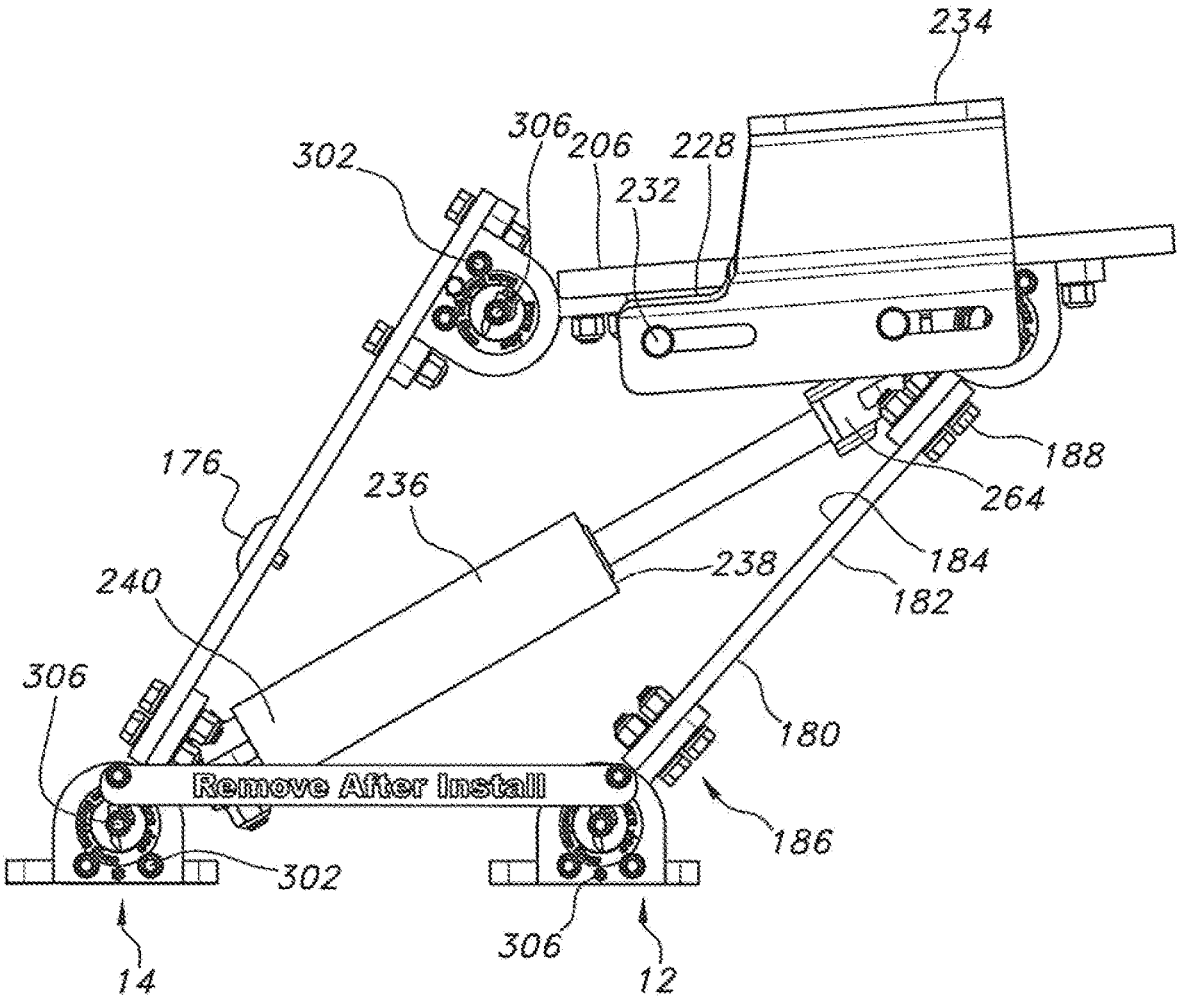
FIG. 8 is a left side elevational view thereof.
Figure 9:
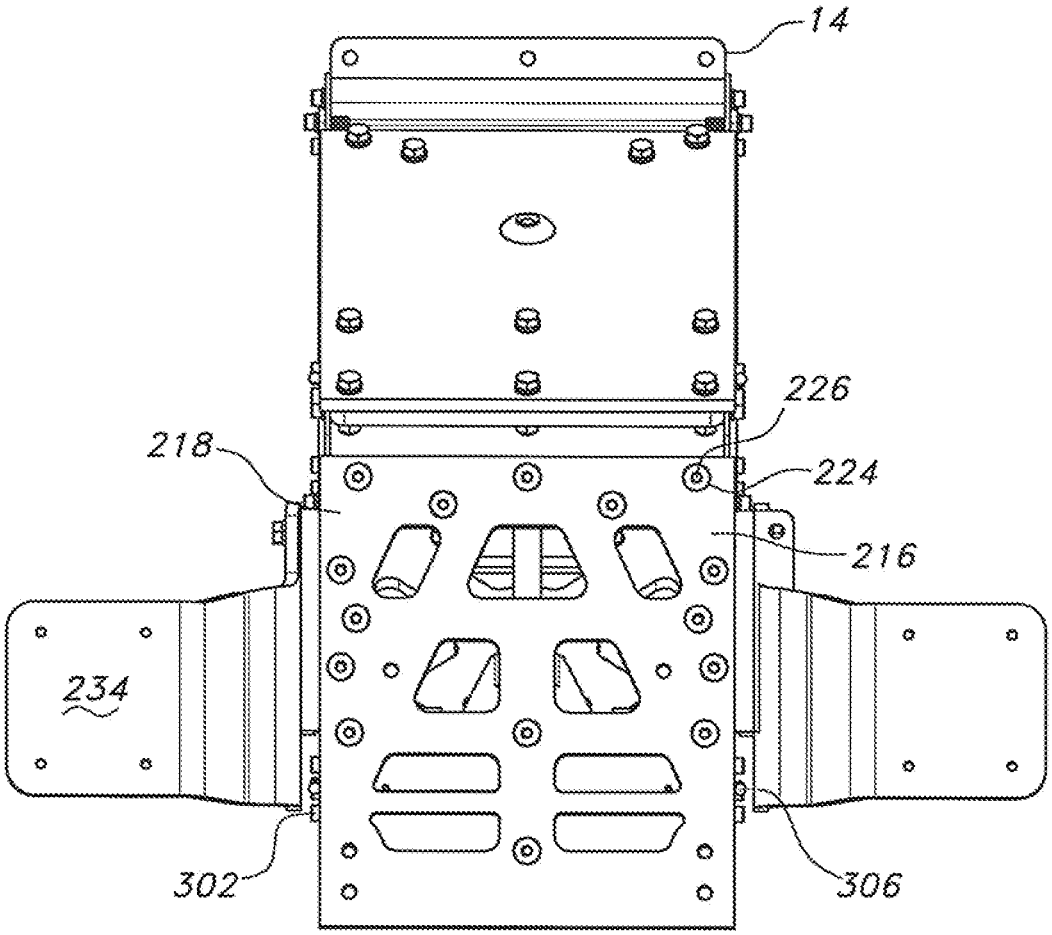
FIG. 9 is a rear elevational view with the jack plate in a fully raised orientation.
Figure 10:
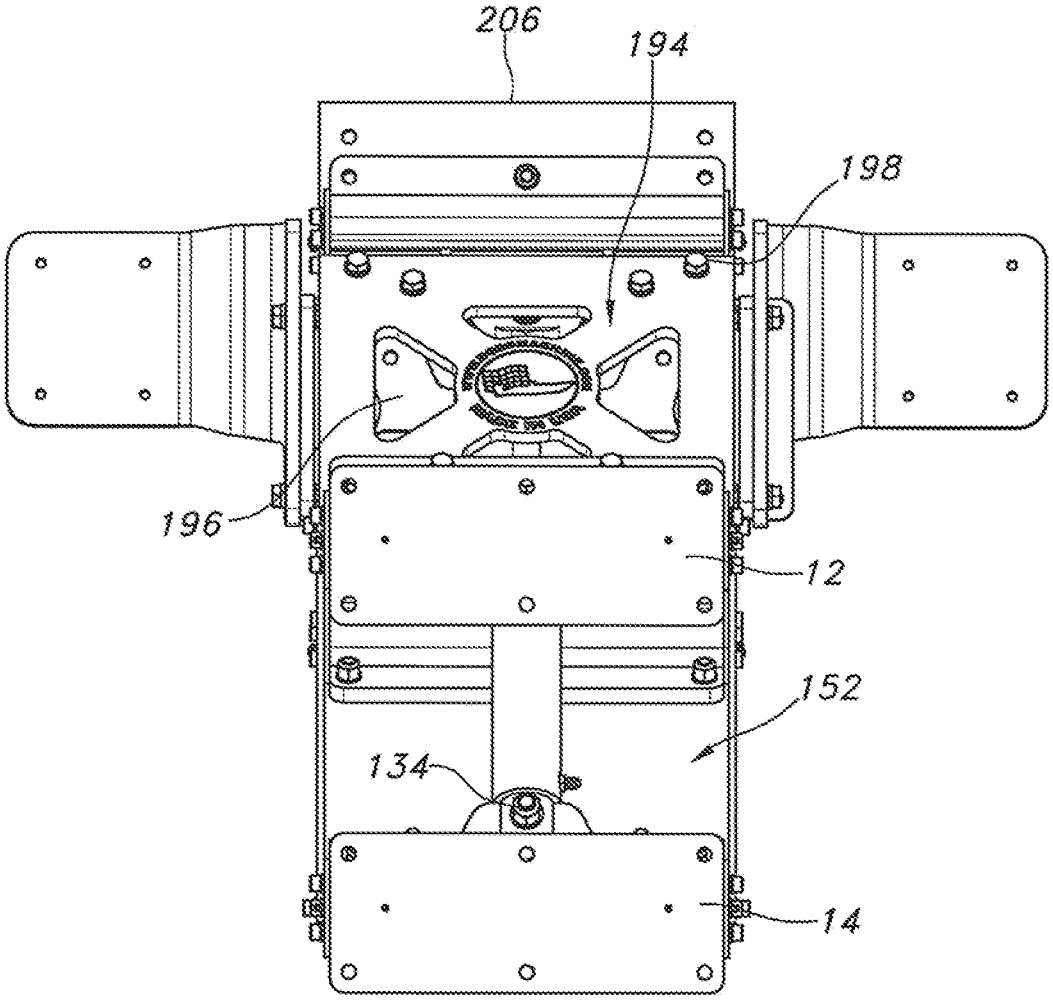
FIG. 10 is a front elevational view with the jack plate in a fully raised orientation.
Figure 13:
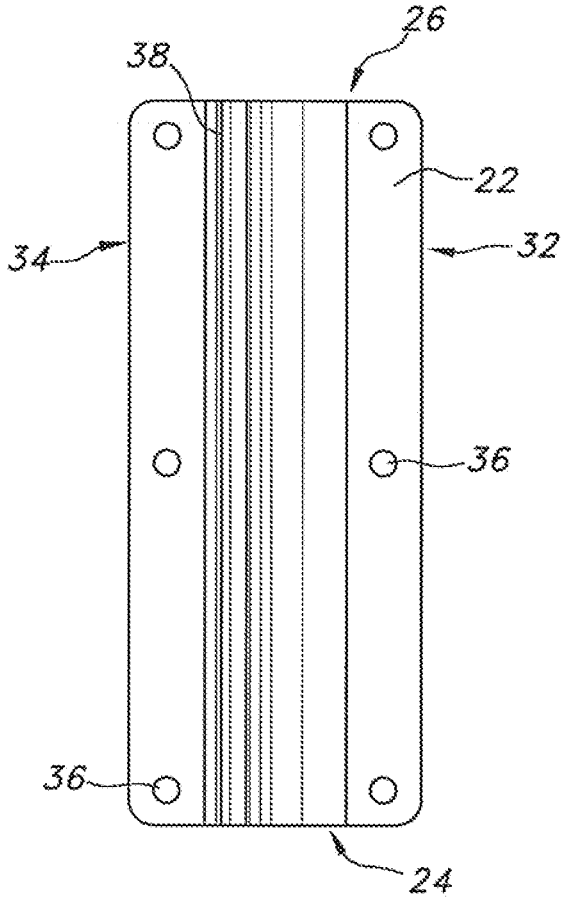
FIG. 13 is a top plan view of a rigid mount.
Figure 11:
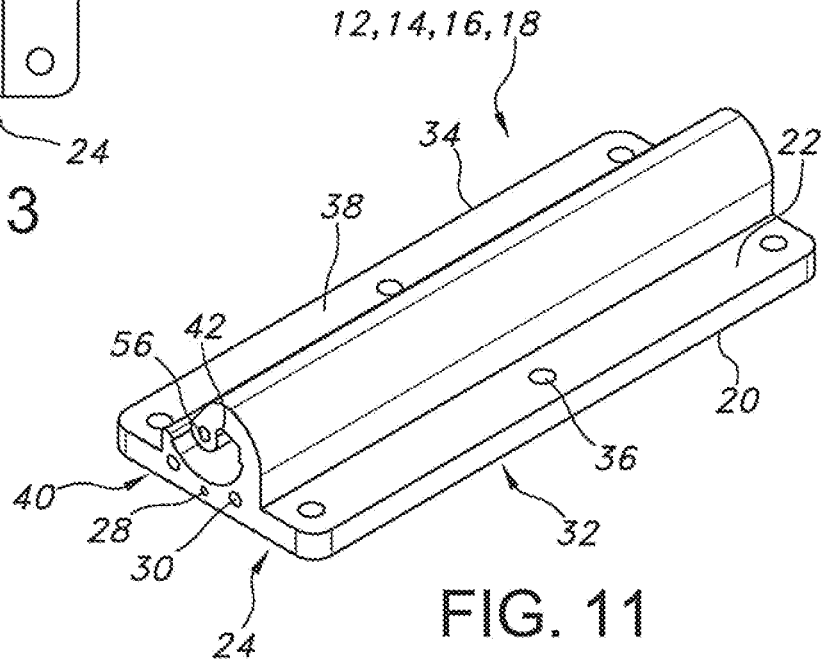
FIG. 11 is a top perspective of a rigid mount.
Figure 12:
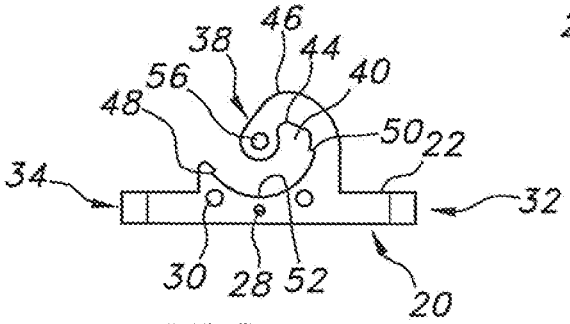
FIG. 12 is a side elevational view of a rigid mount.
Figure 14:
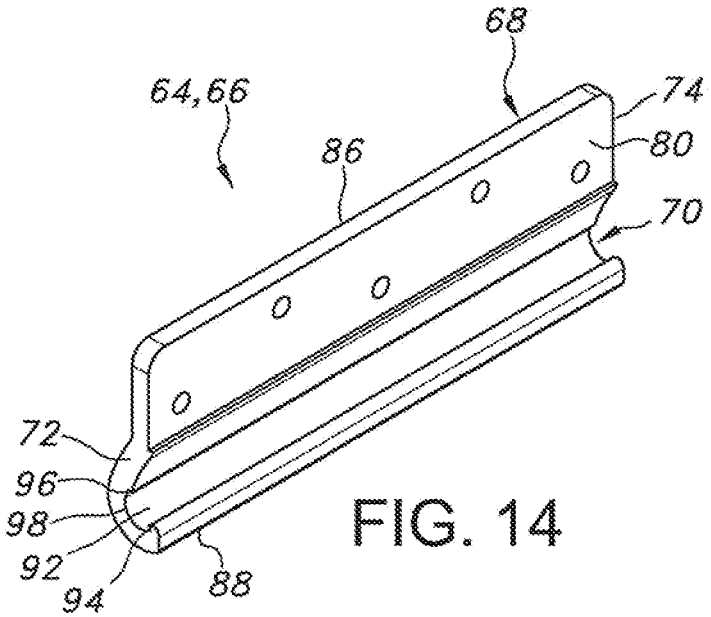
FIG. 14 is a distal perspective view of a long internal hinge.
Figure 15:
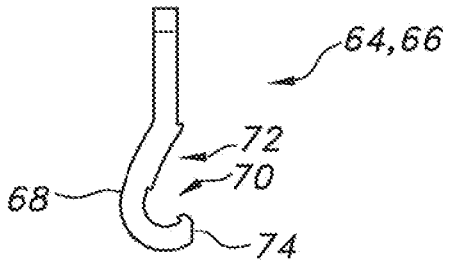
FIG. 15 is a side elevational view of a long internal hinge.
Figure 16:
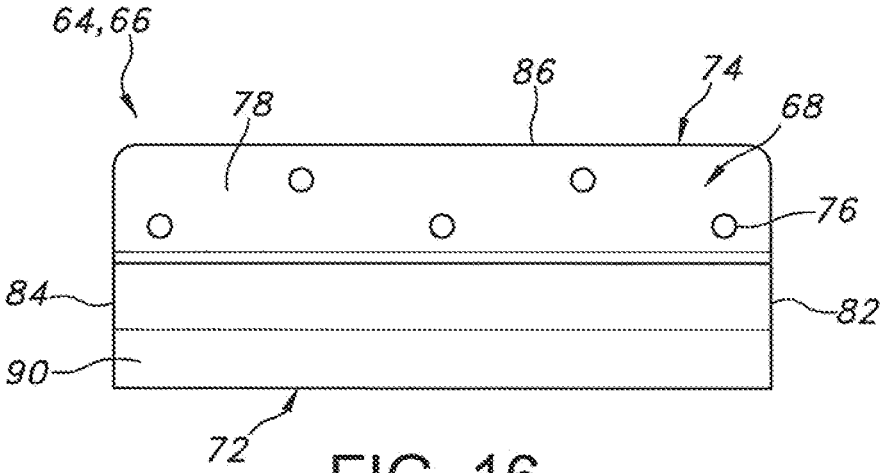
FIG. 16 is a top plan view of a long internal hinge.
Figure 17:
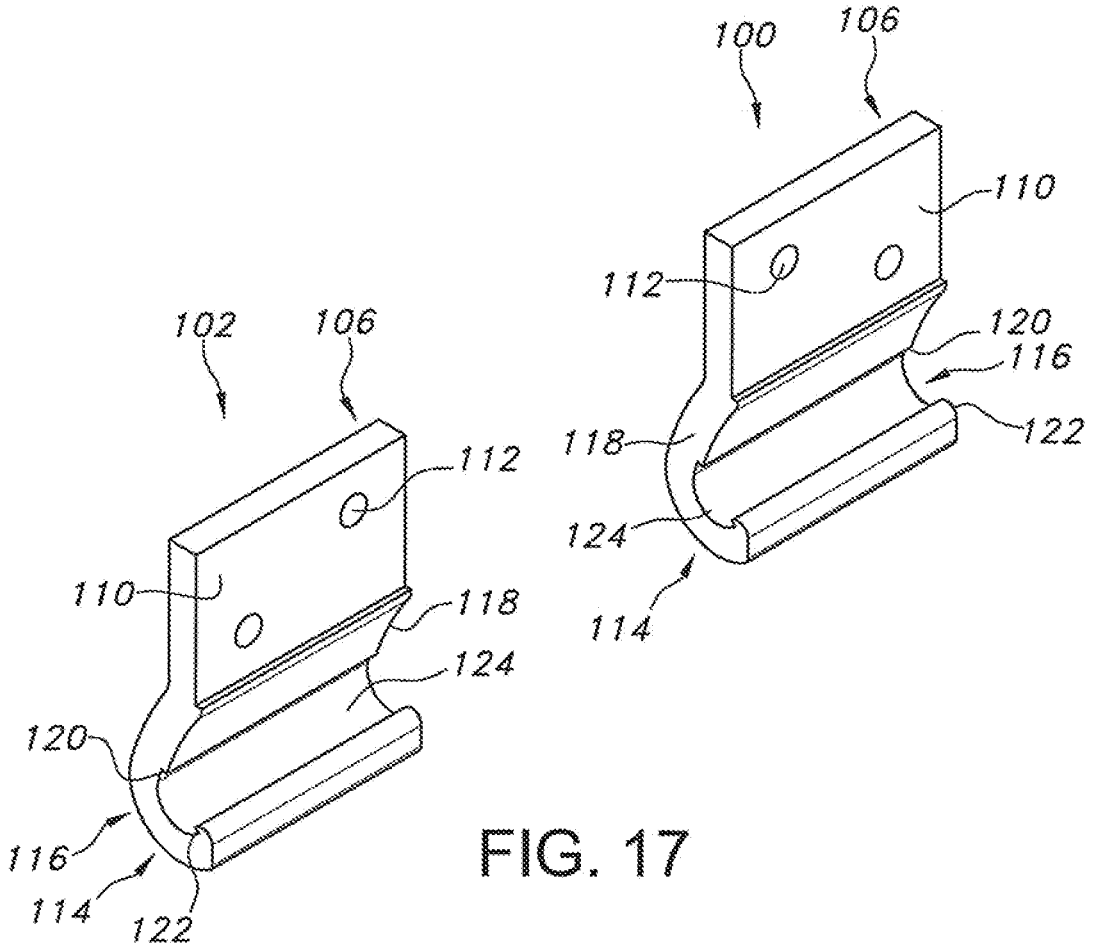
FIG. 17 is distal perspective view of a pair of short internal hinges, being a right internal short hinge and a left internal short hinge.
Figure 18:
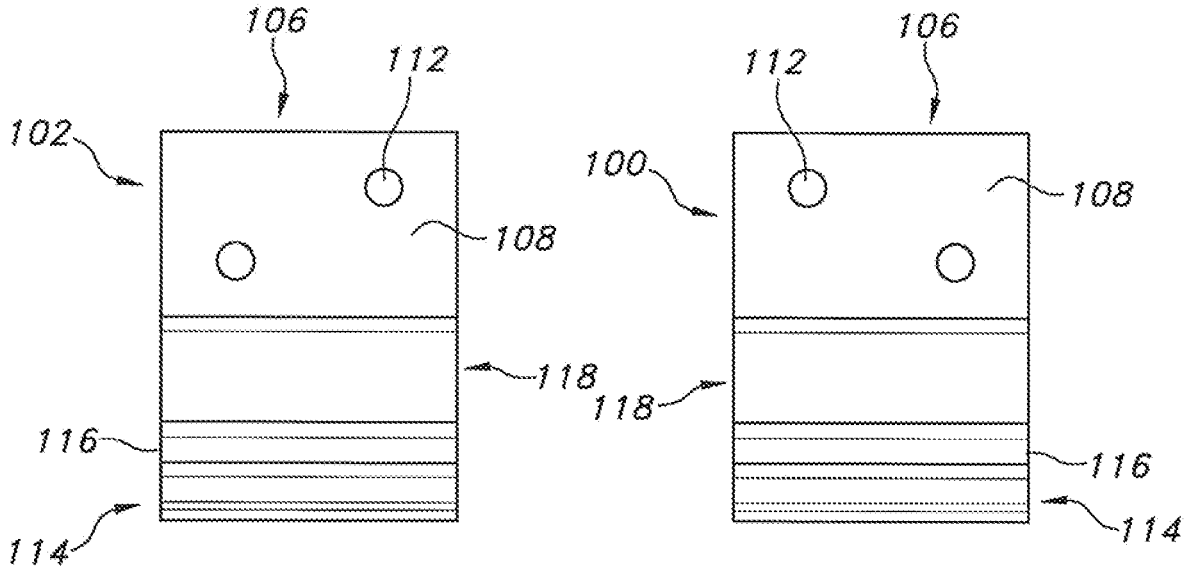
FIG. 18 is a top plan view of a pair of short internal hinges, being a right internal short hinge and a left internal short hinge.
Figure 19:
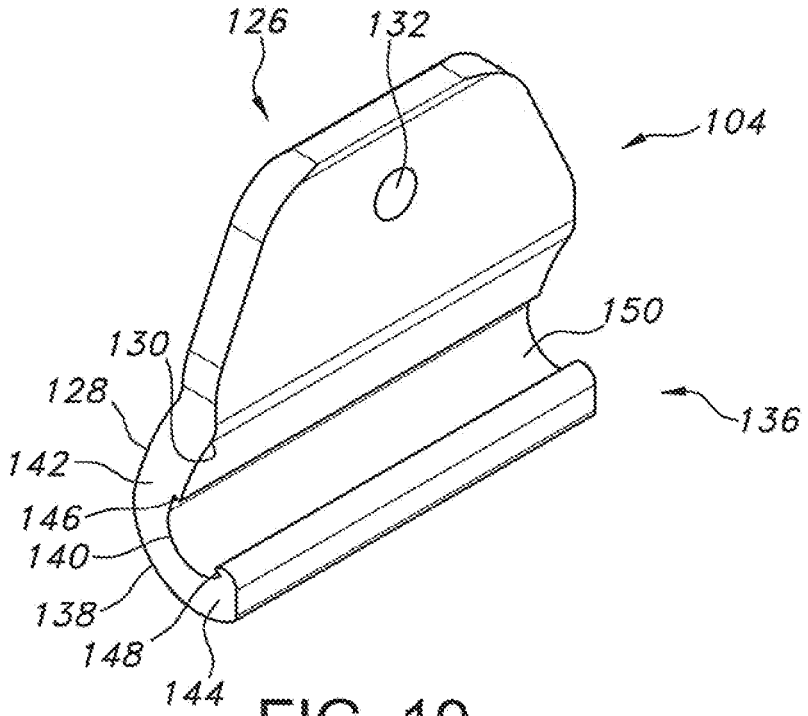
FIG. 19 is a distal perspective of a middle internal short hinge.
Figure 20:
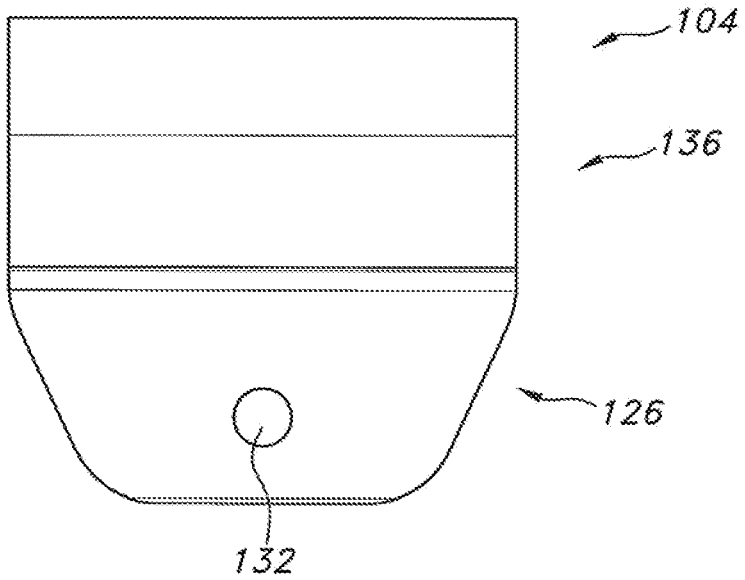
FIG. 20 is a top plan view of a middle internal short hinge.
Figure 21:
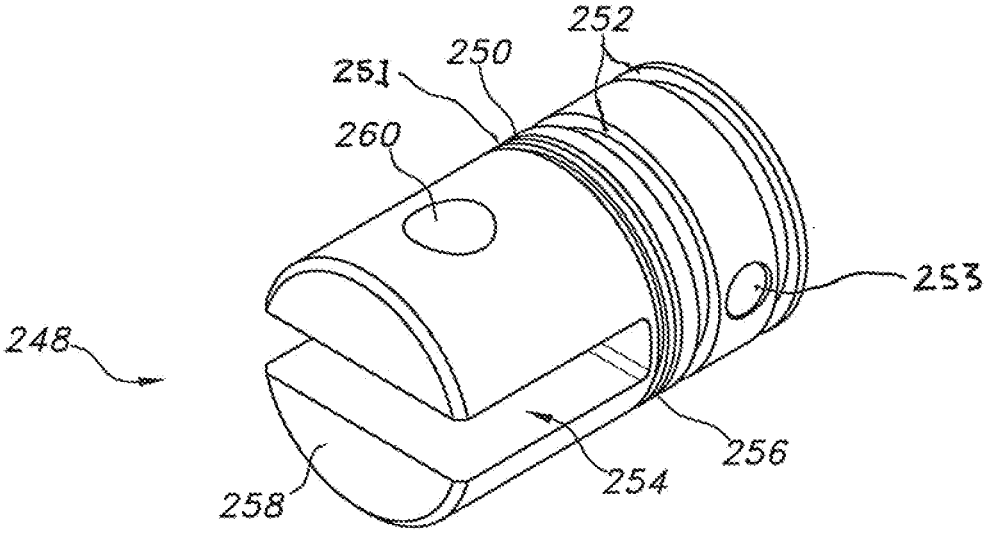
FIG. 21 is a bottom perspective view of a hydraulic cylinder bottom cap.
Figure 22:
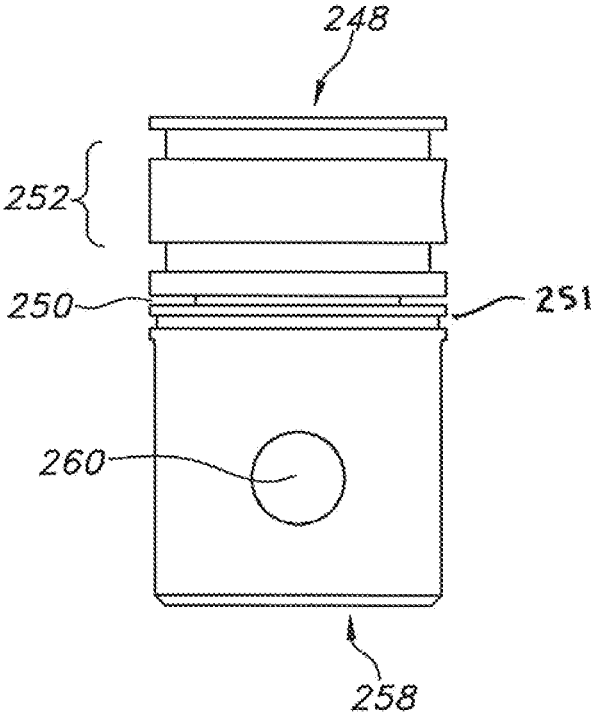
FIG. 22 is a side elevational view of a hydraulic cylinder bottom cap.
Figure 23:
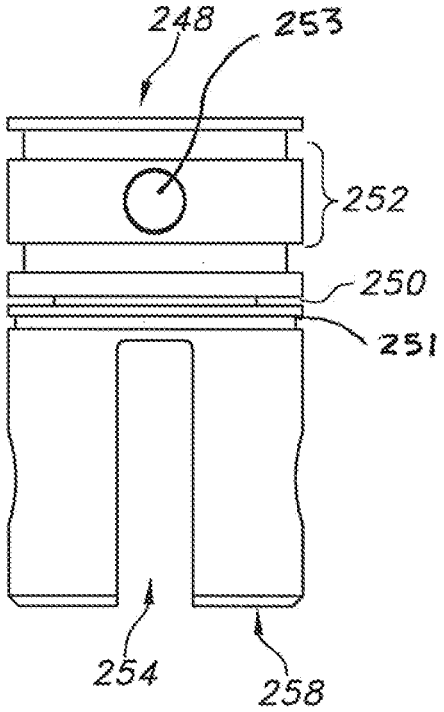
FIG. 23 is another side elevational view of a hydraulic cylinder bottom cap.
Figure 24:
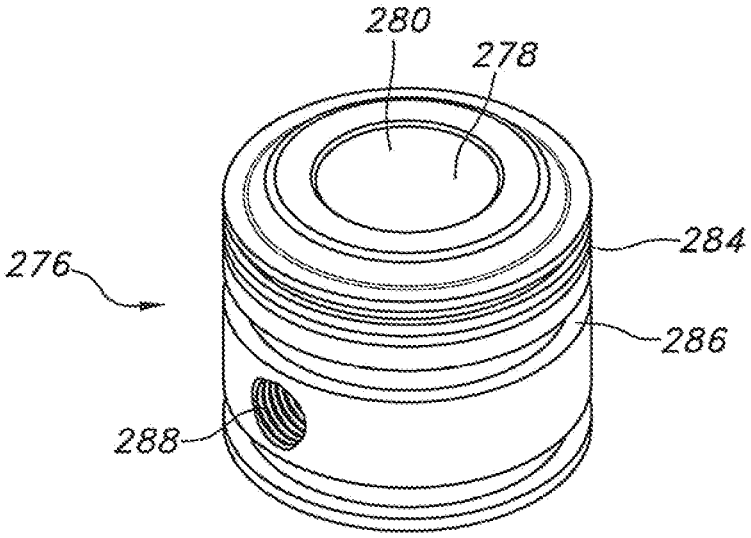
FIG. 24 is top perspective view of a hydraulic cylinder top cap.
Figure 25:
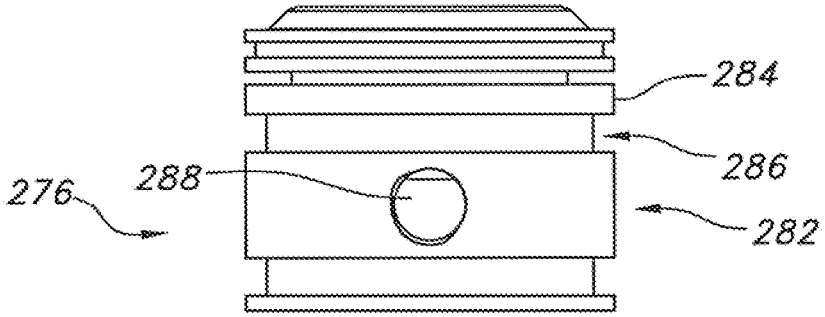
FIG. 25 is side elevational view of a hydraulic cylinder top cap.
Figure 26:
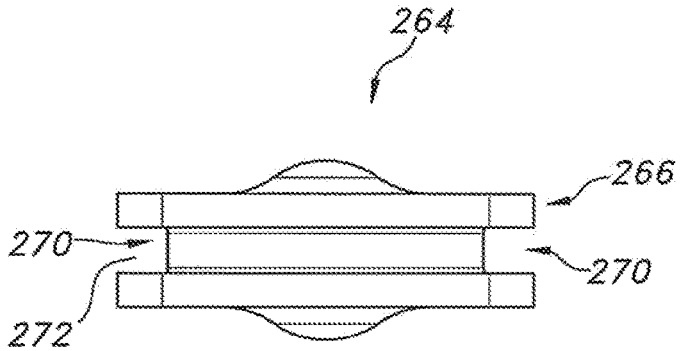
FIG. 26 is top plan view of a hydraulic cylinder top shaft cap.
Figure 29:
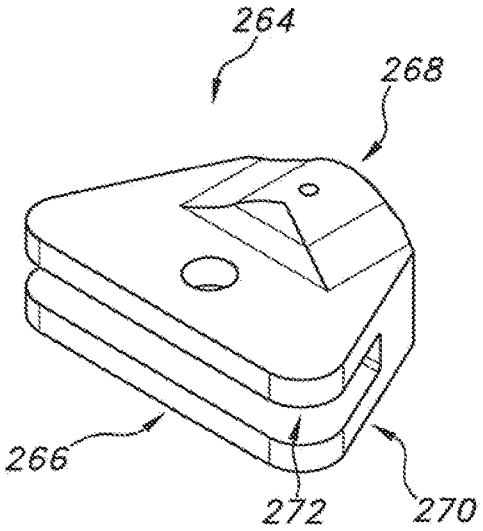
FIG. 29 is another side elevational view of a hydraulic cylinder top shaft cap.
Figure 27:
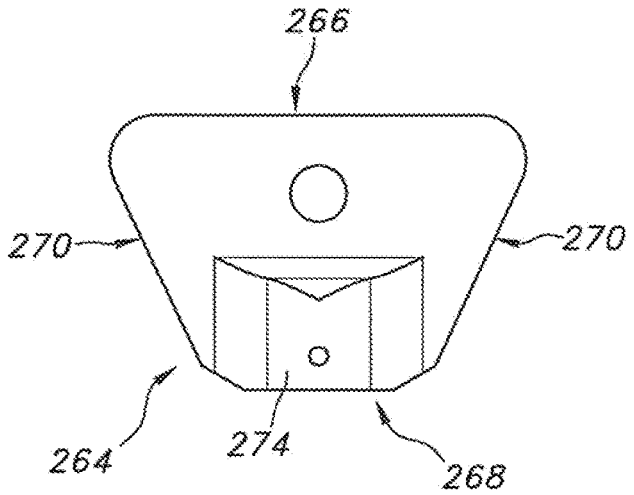
FIG. 27 is top perspective view of a hydraulic cylinder top shaft cap.
Figure 28:
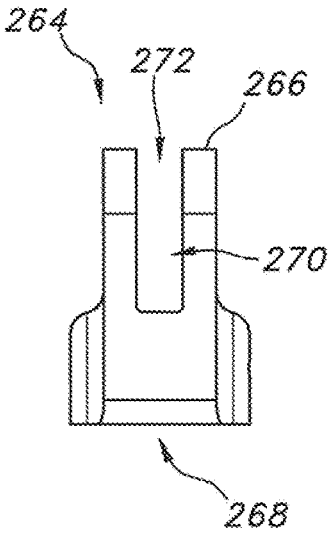
FIG. 28 is side elevational view of a hydraulic cylinder top shaft cap.
Figure 31:
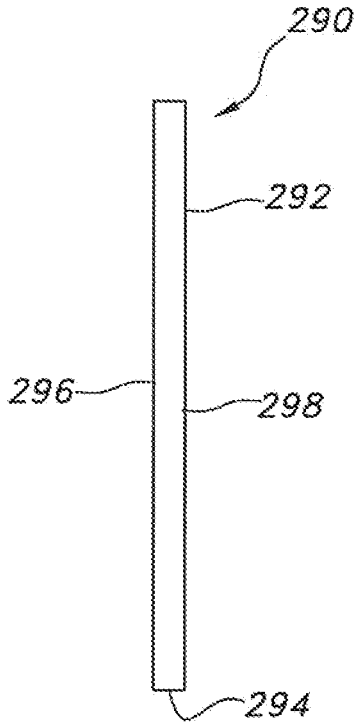
FIG. 31 is a side elevational view of a bracket cap.
Figure 30:
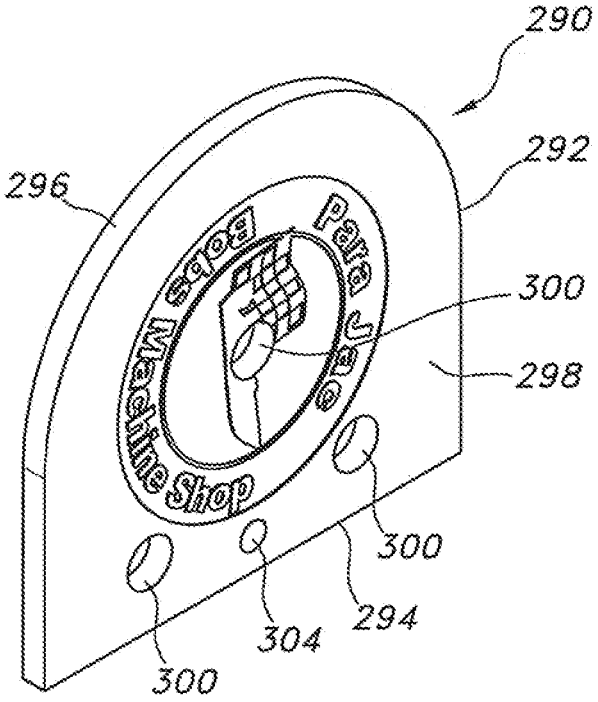
FIG. 30 is a perspective view of a bracket cap.
Figure 32:
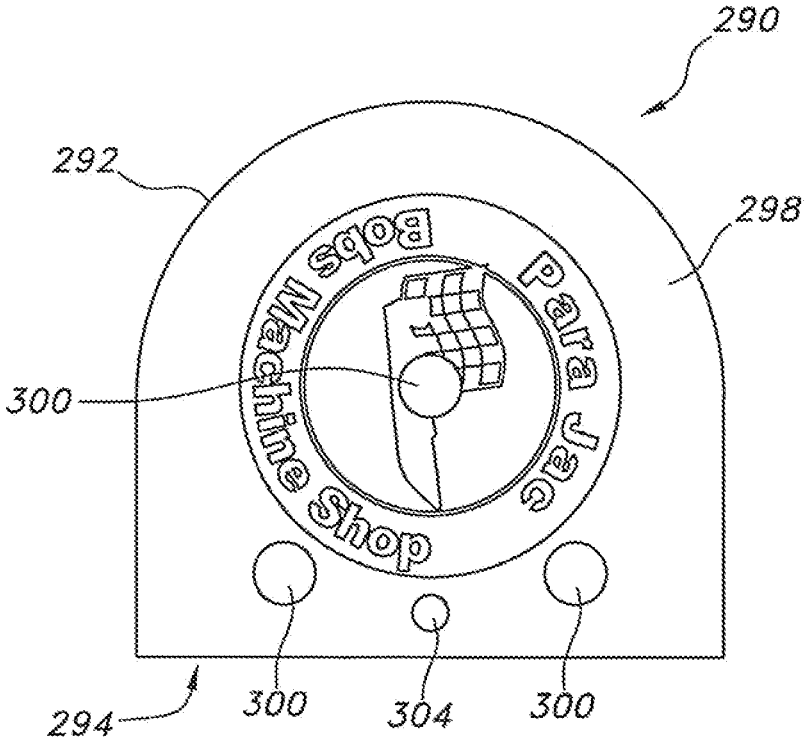
FIG. 32 is a front elevational view of a bracket cap.
Figure 33:
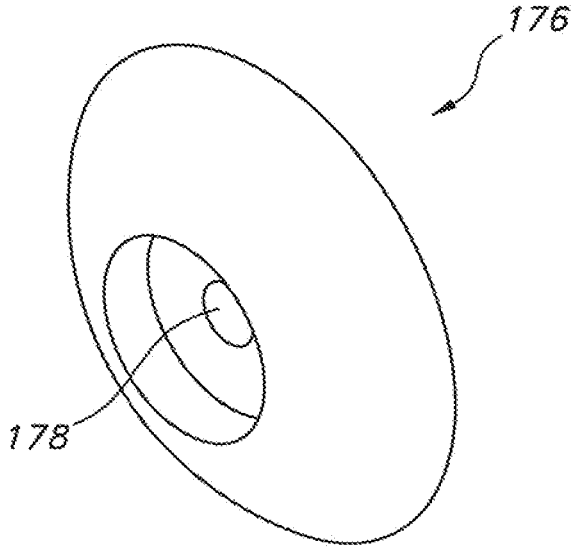
FIG. 33 is a perspective view of a sacrificial anode.
Figure 34:
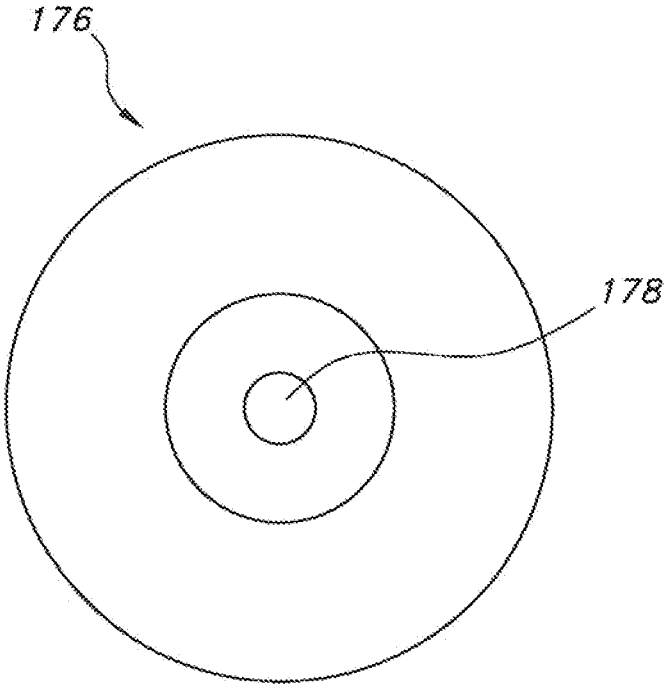
FIG. 34 is a front elevational view of a sacrificial anode.
Figure 35:
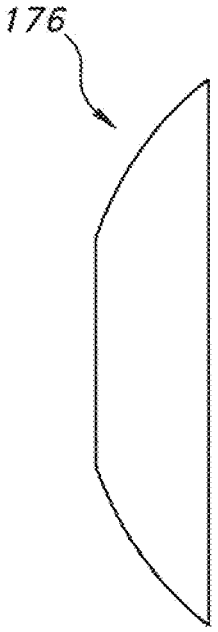
FIG. 35 is a side elevational view of a sacrificial anode.
Figure 37:
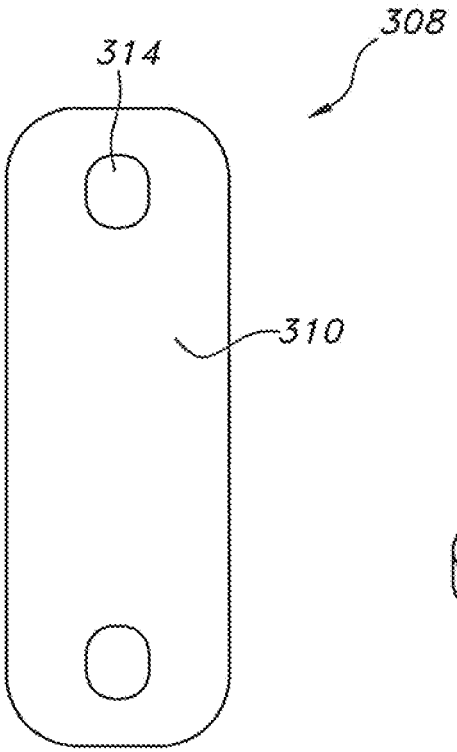
FIG. 37 is a top plan view of a backing plate.
Figure 36:
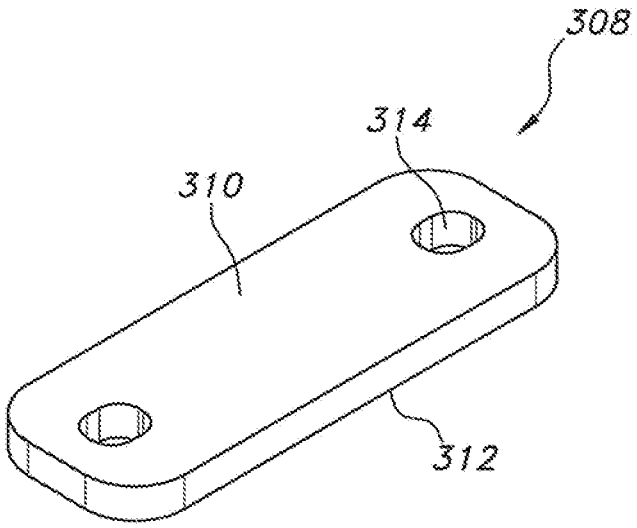
FIG. 36 is a perspective view of a backing plate.
Figure 39:
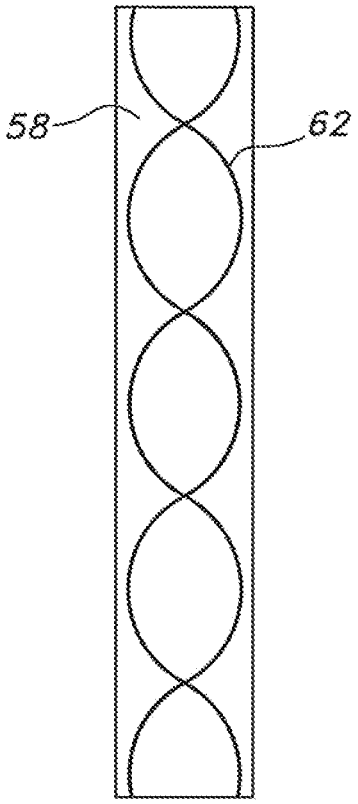
FIG. 39 is a top plan view of a bushing with helical fluting.
Figure 38:
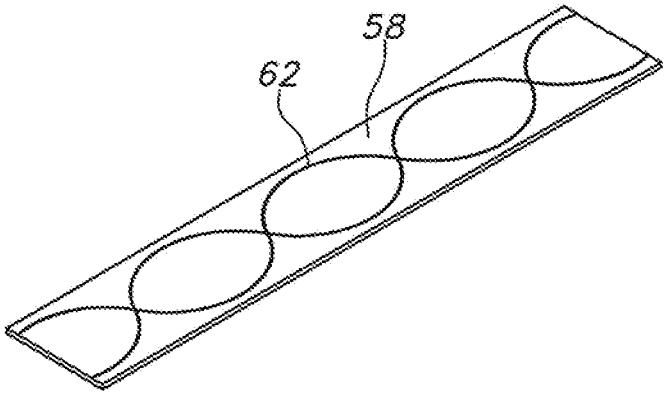
FIG. 38 is a top perspective view of a bushing with helical fluting.
Figure 40:
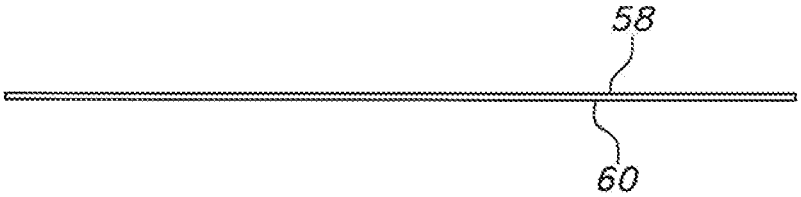
FIG. 40 is a side elevational view of a bushing with helical fluting.

With reference now to the drawings, and in particular to FIG. 1 thereof, the preferred embodiment of the new and improved parallelogram jack plate embodying the principles and concepts of the present invention and generally designated by the reference numeral 10 will be described.

The present invention, the parallelogram jack plate 10 is comprised of a plurality of components. Such components in their broadest context include four rigid mounts, a plurality of hinges, a plurality of bushings with helical fluting, and a hydraulic cylinder. Such components are individually configured and correlated with respect to each other so as to attain the desired objective.

A parallelogram jack plate 10, is comprised of several components, in combination.

There are four rigid mounts, being an upper transom mount 12, a lower transom mount 14, a lower distal mount 16, and an upper distal mount 18. Each of the four mounts have a proximal surface 20 and a distal surface 22, with a thickness there between. Each of the four mounts have a first end 24 and a second end 26, with a length there between. The length of the preferred embodiment of the four rigid mounts is 14.25 inches.

Each of the four rigid mounts first end and each of the four rigid mounts second end have a grease passageway 28 there into and a plurality of threaded bolt holes 30 there into. Each of the four rigid mounts have an upper flange 32 and a lower flange 34, with a length there between. In the preferred embodiment the combined length of the upper flange and the lower flange is 2.593 inches.

The upper flange and the lower flange each have a plurality of bolt holes 36 there through. Each proximal surface of each of the four rigid mounts has an open hinged portion 38. The open hinged portion of each of the four rigid mounts has a curved hook portion 40 having a bushing seat 42. In the preferred embodiment the open hinged portion of each of the four rigid mounts has a radius of curvature of 1.10 inches.

Each of the four rigid mount open hinged portion has an internal surface 44 and an external surface 46. The internal surface of each of the four rigid mounts has open hinged portion having an outer stop 48 and an inner stop 50, with a curved surface there between, forming the bushing seat 52. The grease passageway communicates with the bushing seat The rounded hook portion of each of the four rigid mounts have a distal enlargement and an internal recess 54, with the internal recess being located between the distal enlargement and the rounded hook portion of each of the four rigid mounts. The rounded hook portion of the first end and the second end of each of the four rigid mounts has a threaded bolt hole 56 there into.

There are four rigid mount bushings, two long internal hinge bushings, four short hinge bushings, and two middle internal short hinge bushings. The bushings vary in length but all have similar configuration, being that each has a rectilinear configuration, with an inner surface 58 and an outer surface 60 with a thickness there between. In the preferred embodiment, the thickness of all of the bushings is 0.10 inch.

Each of the bushings has a first end and a second end, with a length there between. In the preferred embodiment, the length of each of the rigid mount bushings is 14.25 inches. The inner surface of each of the bushings has a helical fluting 62 therein, running the length of each of the bushings. In the preferred embodiment the intersecting distance of the helical fluting is between 3.50 inches and 4.50 inches.

There is a pair of long internal hinges, being an upper proximal internal long hinge 64 and a lower distal internal long hinge 66. The upper proximal internal long hinge and the lower distal internal long hinge each have a rectilinear configuration with an upper surface 68 and a lower surface 70 with a thickness there between. The upper proximal internal long hinge and the lower distal internal long hinge each having a hook shaped configuration with a proximal portion 72 and a distal portion 74 with a length there between.

The distal portion of each of the pair of internal long hinges each have a rectilinear configuration with a plurality of bolt holes 76 there through. The proximal portion of each of the internal long hinges each have a curved configuration forming the hook configuration.

The pair of internal long hinges each have a top surface 78, a bottom surface 80, a right side edge 82, a left side edge 84, a distal edge 86, and a proximal edge 88.

Each of the hooks of the pair of internal long hinges have a curved external surface 90 and a curved internal surface 92. The curved internal surface of the proximal portion of each of the pair of internal long hinges have an proximal stop 94 and a distal stop 96, with a curved surface there between, forming a long internal hinge bushing seat 98.

The pair of long internal hinge bushings with each of the long internal hinge bushings having rectilinear configuration, with an inner surface and an outer surface with a thickness there between. Each of the long internal hinge bushings have a first end and a second end with a length there between. The inner surface of each of the long internal hinge bushings have a helical fluting therein running the length of each of the long internal hinge bushings. In the preferred embodiment, the intersecting distance of the helical fluting is between 3.50 inches and 4.50 inches.

There is a pair of internal short hinge assemblies, being a distal upper internal short hinge assembly and a proximal lower internal short hinge assembly. Each of the short hinge assemblies have a right side internal short hinge 100, a left side internal short hinge 102, and a middle internal short hinge 104.

Each of the right side internal short hinges and each of the left side internal short hinges have a distal portion 106 having a rectilinear configuration. The distal portion of the each of the right side internal short hinges and each of the left side internal short hinges have an upper surface 108 and a lower surface 110, with a thickness there between. The distal portion of the each of the right side internal short hinges and each of the left side internal short hinges have a plurality of bolt holes 112 there through. Each of the right side internal short hinges and each of the left side internal short hinges have a proximal portion 114.

The proximal portion of each of the right side internal short hinges and each of the left side internal short hinges have a hook shaped configuration, with a proximal hook portion 116 and a distal hook portion 118, with a length there between. Each of the right side internal short hinges and each of the left side internal short hinges have a proximal stop 120 and a distal stop 122 with a curved bushing surface 124 there between.

The four short hinge bushings each have a rectilinear configuration, with an inner surface and an outer surface with a thickness there between. Each of the short hinge bushings have a first end and a second end, with a length there between. The inner surface of each of the short hinge bushings having a helical fluting therein running the length of each of the long internal hinge bushings. In the preferred embodiment the four short hinge bushings, which are coupled to the right side internal short hinge and the left side internal short hinge, have a length of 4.0 inches.

The two middle internal short hinges of each of the internal short hinge assemblies, each have a proximal portion 126 having a rectilinear configuration with an upper surface 128 and a lower surface 130 with a thickness there between. The proximal portion of each of the internal short hinge assemblies middle short hinge having a bottom cap mounting bolt hole 132 there through, with an associated bottom cap mounting bolt 134.

The distal portion 136 of each of the middle short hinges of the pair of internal short hinge assemblies have a hook shaped configuration, with an upper surface 138, a lower surface 140, and a thickness there between. Each of the pair of internal hinge assemblies middle hinge hook shaped configuration have a proximal hook portion 142 and a distal hook portion 144, with a length there between. Each of the pair of internal short hinge assemblies middle short hinge have a proximal stop 146 and a distal stop 148 with a curved bushing surface 150 there between.

Each of the pair of middle internal short hinge bushings have a rectilinear configuration, with an inner surface and an outer surface with a thickness there between. Each of the middle internal short hinge bushings have a first end and a second end, with a length there between. The inner surface of each of the middle internal short hinge bushings have a helical fluting therein running the length of each of the middle internal short hinge bushings. In the preferred embodiment the pair of middle internal short hinge bushings, which are coupled to each of the middle internal short hinges, have a length of 5.5 inches.

There is a lower plate 152 having a rectilinear configuration with an upper surface 154 and a lower surface 156, with a thickness there between. The lower plate has a proximal portion 158, a distal portion 160, a right side portion 162, a left side portion 164, and a central portion 166. The distal portion of the lower plate has a plurality of bolt holes 168 there through, with associated bolts 170. In the preferred embodiment, the lower plate has a length 18.37 inches and a width of 15.0 inches.

The proximal portion of the lower plate has a plurality of proximal lower internal short hinge assembly bolt holes 172 there through with a plurality of associated lower internal short hinge assembly bolts 174. The proximal portion of the lower plate is coupled to the distal portion of the proximal lower internal short hinge assembly right side short hinge and to the distal portion of the proximal lower internal short hinge assembly left side short hinge, by the associated bolts of the proximal portion of the lower plate.

There is a sacrificial anode 176 which has a rounded configuration with a central hole 178 there through. The sacrificial anode is removably coupled to the lower surface of the lower plate. The sacrificial anode has a diameter of 1.969 inches, with a central hole having a diameter of 0.256 inches There is an upper plate 180. The upper plate has a rectilinear configuration with an upper surface 182 and a lower surface 184, with a thickness there between. The upper plate has a proximal portion 186, a distal portion 188, a right side portion 190, a left side portion 192, and a central portion 194. The central portion has a plurality of taper shaped holes 196 there through.

The distal portion of the upper plate has a plurality of internal short hinge bolt holes 198 there through.

The proximal portion of the upper plate has a plurality of flange bolt holes 200 there through, with each flange bolt hole having an associated upper plate flange bolt 202. The distal portion of the upper plate has the upper internal right side short hinge, and upper internal left side short hinge, coupled thereto by the associated bolts of the distal portion of the upper plate.

The distal portion of the right side internal short hinge and the distal portion of the left side lower internal hinge are coupled to the upper plate distal portion, using the upper internal hinge mounting hole associated bolts 204.

The upper proximal internal long hinge is coupled to the proximal portion of the upper plate by the associated bolts 202. The upper proximal internal long hinge is rotatably coupled to the upper transom mount distal surface open hinged portion with the proximal hook shaped portion of the upper internal long hinge being mated with and received by the upper hinged portion of the upper transom mount. In the preferred embodiment, the upper plate has a length of 14.0 inches and a width of 15.0 inches.

There is a motor mount plate 206. The motor mount plate has a proximal surface 208 and a distal surface 210, with a thickness there between. The motor mount plate has a top edge 212 and a bottom edge 214, with a length there between. The motor mount plate has a right side edge 216 and a left side edge 218, with a thickness there between. The motor mount plate has a top portion adjacent to the top edge and a bottom portion adjacent to the bottom edge.

The top portion of the motor mount plate has a plurality of upper distal rigid mount bolt holes 220 there through, with a plurality of associated upper distal rigid mount bolts 222.

The bottom portion of the motor mount plate has a plurality of lower distal rigid mount bolt holes 224 there through, with a plurality of associated lower distal rigid mount bolts 226.

The top portion of the motor mount plate is coupled to the upper distal rigid mount. The bottom portion of the motor mount plate is coupled to the lower distal rigid mount. The upper distal short hinge assembly is rotatably coupled to the upper distal rigid mount. The lower distal internal long hinge is coupled to the bottom portion of the motor mount plate. The lower distal internal long hinge is rotatably coupled to the lower distal mount. In the preferred embodiment, the motor mount plate has a length of 17.0 inches and a width of 15.0 inches.

There is a pair of accessory mounting plates 228 having an L-shaped configuration. Each of the pair of accessory mounting plates have bolt holes 230 there through. Each of the accessory mounting plate holes has an associated bolt 232 Each of the accessory mounting plates is removably coupled to the motor mount plate. The accessory mounting plates allow other devices, such as mechanical anchoring devices. The mounting is usually achieved by the addition of the adapting plates 234, which have a winged configuration.

There is a bi directional hydraulic cylinder 236, referred to, herein, as the hydraulic cylinder. The hydraulic cylinder has an upper end 238 and a lower end 240, with a length there between. The length of the hydraulic cylinder has a centrally located piston passageway 242 there through. The piston passageway runs from the upper end of the hydraulic cylinder to the lower end of the hydraulic cylinder.

The hydraulic cylinder upper end piston passageway has at least one snap ring groove 244 therein. There is also a snap ring groove at the lower end of the hydraulic cylinder in the lower end piston passageway, which is the interior surface of the hydraulic cylinder. The hydraulic cylinder has an associated ram 246, with the ram having an upper end and a lower end.

The hydraulic cylinder has a bottom cap 248 and a top shaft cap. The hydraulic cylinder lower end has the smooth inner surface, as previously described. The hydraulic cylinder lower end has the bottom cap. The bottom cap upper end is configured to be press fit into the interior surface of the hydraulic cylinder. The bottom cap has a plurality of circumferential recesses therein being a snap ring groove 250, an oil seal ring groove 251, and two o-ring grooves 252. The upper end of the bottom cap has a dual purpose hole 253, which serves as an indexing hole, thereby preventing any rotation of the bottom cap, and an access port for a hydraulic fluid fitting (not shown, but well known in the prior art). The hydraulic cylinder bottom cap has a slot 254 running from a median portion 256 to a bottom end 258. The hydraulic cylinder bottom cap has a pin hole 260 running through the median portion, with the pin hole being orthogonal to the slot. The bottom cap pin hole running across the slot. The bottom cap pin hole has an associated pin 262. In the preferred embodiment, the bottom cap has a diameter of 2.0 inches and a height of 3.295 inches.

The slot is configured to receive and mate with the proximal portion of one of the internal short hinge assemblies middle short hinges, with the bottom cap mounting bolt coupling the proximal lower internal short hinge assembly middle short hinge to the bottom cap of the hydraulic cylinder. In the preferred embodiment, the bottom cap slot has a width of 0.5 inches and a height of 1.795 inches.

The hydraulic cylinder ram upper end top shaft cap 264 has a trapazoidal configuration, with an upper extent 266, a lower extent 268, and two sides 270 there between. The upper extent has a slot 272 there in.

The lower extent of the top shaft cap has a round recess 274 therein, so as to mate with and receive the hydraulic cylinder ram upper end. The ram upper end top shaft cap upper extent is configured to mate with and receive the proximal portion of a middle internal short hinge of one of the internal short hinge assemblies. The associated lower cap mounting bolt is used to couple the proximal portion of one of the internal short hinge assemblies middle short hinge to the upper end of the ram upper end top shaft cap.

The hydraulic cylinder upper end has a top cap 276. The hydraulic cylinder upper end top cap has a cylindrical configuration, with a ram hole 278 there through. The hydraulic cylinder upper end top cap has a smooth interior surface 280 and an exterior surface 282. The hydraulic cylinder upper end top cap exterior surface has a plurality of grooves there in, with the hydraulic cylinder upper end top cap plurality of grooves having at least one snap ring 284 and at least one o-ring 286. The hydraulic cylinder upper end top cap exterior surface has a hole 288 therein, which serves as a dual purpose hole, serving as an indexing hole, thereby preventing any rotation of the upper end top cap, and as an access port for a hydraulic fluid fitting (not shown, but well known in the prior art). The top cap is configured to be permanently fixed within the hydraulic cylinder piston passageway once it is inserted into the centrally located piston passageway of the hydraulic cylinder.

There is a plurality of bracket caps 290. The bracket caps each have a curved upper edge 292 and a flat lower edge 294. Each bracket cap has an inner surface 296 and an outer surface 298, with a width there between. Each of the bracket caps has a plurality of bolt holes 300 there through, with a plurality of associated bracket cap bolts 302. Each of the bracket caps have a grease fitting hole 304 there through. Each grease fitting hole of each of the bracket caps has an associated grease fitting 306. In the preferred embodiment, the bracket caps each have a height of 3.323 inches and a width of 3.529 inches.

There is a plurality of backing plates 308. Each backing plate has a rectilinear configuration with a forward surface 310 and a rearward surface 312, with a thickness there between. Each of the plurality of backing plates have a pair of bolt holes 314 there through. The backing plates being used to reinforce attachment of the parallelogram jack plate to a hull of an existing boat. The backing plates are place on the inside of the existing hole, and the parallelogram jack plate is mounted on the outside of the existing boat hull.

Lastly, there is a hydraulic fluid source and hydraulic fluid source control, which is well known in the art and will not be discussed in any detail.

The invention, herein described, is an improvement in an existing jack plate, which is the subject of issued U.S. Pat. No. 5,075,927, issued to Porta. The improvements include several aspects which make the manufacture more cost effective, and the product more durable.

The first improvement is the use of bushings with helical fluting. The fluting is not straight line, which allows more linear distance of the fluting over the length of the bushing. The intersecting helical configuration allows for grease transfer from one flute to another at the points of intersection, thereby lessening the incidence of dry, or ungreased, areas. In essence, there are only two flutes, with a run length longer than the length of the bushing itself. The use of only two helical flutes means that there is the maximum amount of bushing contact area with the rotating part, imparting durability to the bushing surface.

Another improvement is the use of a sealable bi directional hydraulic cylinder. The top cap slides over the ram, into the cylinder to the point where an installed snap ring engages the snap ring groove in the upper cylinder interior surface. It is at this point the pair of o-rings are engaged within the cylinder interior surface, forming a seal. The use of the snap ring to secure the top cap lessens production cost as there is no need for threading of the interior of the cylinder to accept a threaded top cap. Additionally, the top end of the cylinder need not be further machined with a greater interior diameter to accept the threaded top cap and the requisite o-ring seals.

Another improvement is the addition of the accessory mounting plates, which provides a user with a mounting surface for such devices as mechanical straight line mechanical anchors, which are popular, in wide use. Previous devices lacked the mounting potential, which necessitated mounting such mechanical anchoring devices to the boat hull itself.

Lastly, another improvement is the use of a sacrificial anode, which is coupled to the lower plate, in contact with the water, thereby lessening the corrosive effects of salt water on the metal parts.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A parallelogram jack plate, comprising, in combination: four rigid mounts being an upper transom mount and a lower transom mount and a lower distal mount and an upper distal mount, each of the four rigid mounts having a bushing seat therein;

four rigid mount bushings with each rigid mount bushing having a rectilinear configuration with an inner surface and an outer surface with a thickness there between, each of the rigid mount bushings having a first end and a second end with a first length there between, the inner surface of each of the rigid mount bushings having a helical fluting therein running the first length of each of the rigid mount bushings;

a pair of long internal hinges, being an upper proximal internal long hinge and a lower distal internal long hinge, the upper proximal internal long hinge and the lower distal internal long hinge each having a rectilinear configuration with an upper surface and a lower surface with a thickness there between, the upper proximal internal long hinge and the lower distal internal long hinge each having a hook shaped configuration with a proximal portion and a distal portion, each of the hook shaped configurations of the pair of internal long hinges having a curved external surface and a curved internal surface with the curved internal surface of the proximal portion of each of the pair of internal long hinges having a proximal stop and a distal stop with a curved surface there between forming a long internal hinge bushing seat;

a pair of long internal hinge bushings with each of the long internal hinge bushings having a rectilinear configuration with an inner surface and an outer surface with a thickness there between, each of the long internal hinge bushings having a first end and a second end with the first length there between, the inner surface of each of the long internal hinge bushings having a helical fluting therein running the first length of each of the long internal hinge bushings;

a pair of internal short hinge assemblies, being a distal upper internal short hinge assembly and a proximal lower internal short hinge assembly with each of the short hinge assemblies each having a right side internal short hinge and a left side internal short hinge and a middle internal short hinge, each of the right side internal short hinges and each of the left side internal short hinges each having a distal portion having a rectilinear configuration, with the distal portion of the each of the right side internal short hinges and each of the left side internal short hinges each having an upper surface and a lower surface with a thickness there between, each of the right side internal short hinges and each of the left side internal short hinges each having a proximal portion with the proximal portion of each of the right side internal short hinges and each of the left side internal short hinges each having a hook shaped configuration with a proximal hook portion and a distal hook portion with a length there between, each of the right side internal short hinges and each of the left side internal short hinges each having a proximal stop and a distal stop with a curved bushing surface there between;

four short hinge bushings with each of the short hinge bushings having a rectilinear configuration with an inner surface and an outer surface with a thickness there between, each of the short hinge bushings having a first end and a second end with a second length there between, the inner surface of each of the short hinge bushings having a helical fluting therein running the length of each of the long internal hinge bushings, the first length being longer than the second length;

the middle internal short hinge of each of the internal short hinge assemblies having a proximal portion having rectilinear configuration with an upper surface and a lower surface with a thickness there between, the distal portion of each of the middle short hinges of the pair of internal short hinge assemblies each having a hook shaped configuration with an upper surface and a lower surface with a thickness there between, the pair of internal hinge assemblies middle hinge hook shaped configuration having a proximal hook portion and a distal hook portion with a third length there between, each of the pair of internal short hinge assemblies middle short hinge having a proximal stop and a distal stop with a curved bushing surface there between;

a pair of middle internal short hinge bushings with each of the middle internal short hinge bushings having a rectilinear configuration with an inner surface and an outer surface with a thickness there between, each of the middle internal short hinge bushings having a first end and a second end with a third length there between, the inner surface of each of the middle internal short hinge bushings having a helical fluting therein running the third length of each of the middle internal short hinge bushings;

a lower plate having a rectilinear configuration with an upper surface and a lower surface with a thickness there between, the lower plate having a proximal portion and a distal portion and a right side portion and a left side portion and a central portion, the distal portion of the lower plate having a plurality of bolt holes there through with associated bolts, the proximal portion of the lower plate having a plurality of proximal lower internal short hinge assembly bolt holes there through with a plurality of lower internal short hinge assembly bolts, the proximal portion of the lower plate being coupled to the distal portion of the proximal lower internal short hinge assembly right side short hinge and to the distal portion of the proximal lower internal short hinge assembly left side short hinge by the associated bolts of the proximal portion of the lower plate;

a sacrificial anode having a rounded configuration with a central hole there through, the sacrificial anode being removably coupled to the lower surface of the lower plate;

an upper plate having a rectilinear configuration with an upper surface and a lower surface with a thickness there between, the upper plate having a proximal portion and a distal portion and a right side portion and a left side portion and a central portion, the distal portion of the upper plate having a plurality of internal short hinge bolt holes there through, the distal portion of the right side internal short hinge and the distal portion of the left side lower internal hinge being coupled to the upper plate distal portion using the upper internal hinge mounting hole associated bolts, the upper proximal internal long hinge being coupled to the proximal portion of the upper plate by the associated bolts, the upper proximal internal long hinge being rotatably coupled to the upper transom mount distal surface open hinged portion with the proximal hook shaped portion of the upper internal long hinge being mated with and received by the upper hinged portion of the upper transom mount;

a motor mount plate having a proximal surface and a distal surface with a thickness there between, the motor mount plate having a top edge and a bottom edge with a length there between, the motor mount plate having a right side edge and a left side edge with a width there between, the motor mount plate having a top portion adjacent to the top edge and a bottom portion adjacent to the bottom edge, the top portion of the motor mount plate having a plurality of upper distal rigid mount bolt holes there through with a plurality of associated upper distal rigid mount bolts, the bottom portion of the motor mount plate having a plurality of lower distal rigid mount bolt holes there through with a plurality of associated lower distal rigid mount bolts, the top portion of the motor mount plate being coupled to the upper distal rigid mount, the bottom portion of the motor mount plate being coupled to the lower distal rigid mount, the upper distal short hinge assembly being rotatably coupled to the upper distal rigid mount, the lower distal internal long hinge being coupled to the bottom portion of the motor mount plate, the lower distal internal long hinge being rotatably coupled to the lower distal mount;

a hydraulic cylinder having an upper end and a lower end with a length there between, the hydraulic cylinder having an interior surface and an exterior surface, with a thickness there between, the length of the hydraulic cylinder having a centrally located piston passageway there through forming the interior surface, the hydraulic cylinder upper end interior surface having at least one snap ring groove therein, the hydraulic cylinder having a ram with an upper end and a lower end, the hydraulic cylinder having a bottom cap and a top cap, the hydraulic cylinder lower end having the bottom cap with the bottom cap having a plurality of circumferential recesses therein, the hydraulic cylinder bottom cap having a slot running from a median portion to a bottom end, the hydraulic cylinder bottom cap having a pin hole running through the median portion with the pin hole being orthogonal to the slot, and running across the slot, the slot being configured to receive and mate with the proximal portion of one of the internal short hinge assemblies middle short hinges with the bottom cap mounting bolt coupling the proximal lower internal short hinge assembly middle short hinge to the bottom cap of the hydraulic cylinder;

the hydraulic cylinder ram upper end having an associated top shaft cap, the hydraulic cylinder ram upper end top shaft cap having a trapazoidal configuration with an upper extent and a lower extent and two sides there between, the upper extent having a slot there in, the lower extent having a round recess therein so as to mate with and receive the hydraulic cylinder ram upper end, the ram upper end top shaft cap upper extent being configured to mate with and receive the proximal portion of a middle internal short hinge of the internal short hinge assemblies with the associated lower cap mounting bolt being used to couple the proximal portion of one of the internal short hinge assemblies middle short hinge to the upper end of the ram upper end top shaft cap;

the hydraulic cylinder upper end having a top cap, the hydraulic cylinder upper end top cap having a cylindrical configuration and the hydraulic cylinder top cap is sized to be sit into the hydraulic cylinder interior surface, the hydraulic cylinder top cap having a ram hole there through, the hydraulic cylinder upper end top cap having a plurality of grooves there in with the hydraulic cylinder upper end top cap plurality of grooves having at least one snap ring and at least one o-ring, the top cap being permanently fixed within the hydraulic cylinder interior surface once it is inserted into the centrally located piston passageway of the hydraulic cylinder;

a plurality of bracket caps, the bracket caps each having a curved upper edge and a flat lower edge, each bracket cap having an inner surface and an outer surface with a width there between, each of the bracket caps having a plurality of bolt holes there through with a plurality of associated bracket cap bolts, each of the bracket caps having a grease fitting hole there through, with each grease fitting hole of each of the bracket caps having an associated grease fitting; and a hydraulic fluid source and hydraulic fluid source control with the hydraulic fluid source and the hydraulic fluid source control being operatively coupled to the hydraulic cylinder.

2. The parallelogram jack plate as described in claim 1, with the parallelogram jack plate further comprising:

each of the four mounts having a first end and a second end with a length there between, each of the four mounts first end and each of the four rigid mounts second end each having a grease passageway there into and a plurality of threaded bolt holes there into;

the distal portion of each of the pair of internal long hinges each having a rectilinear configuration with a plurality of bolt holes there through, the proximal portion of each of the internal long hinges each having a curved configuration forming the hook configuration, the pair of internal long hinges each having a top surface and a bottom surface and a right side edge and a left side edge and a distal edge and a proximal edge; and the distal portion of the each of the right side internal short hinges and each of the left side internal short hinges each having a plurality of bolt holes there through.

3. The parallelogram jack plate as described in claim 2, with the parallelogram jack plate further comprising:

each of the four mounts having a proximal surface and a distal surface with a thickness there between, each of the four mounts having an upper flange and a lower flange with a length there between; and the proximal portion of each of the internal short hinge assemblies middle short hinge having a bottom cap mounting bolt hole there through, with an associated bottom cap mounting bolt.

4. The parallelogram jack plate as described in claim 3, with the parallelogram jack plate further comprising:

the upper flange and the lower flange of each of the four rigid mounts each having a plurality of bolt holes there through each distal surface of each of the four rigid mounts, the distal surface of each of the four mounts has an open hinged portion, the open hinged portion of each of the four rigid mounts has a curved hook portion forming the bushing seat;

the third length being longer than the second length and shorter than the first length; and the proximal portion of the upper plate having a plurality of flange bolt holes there through with each flange bolt hole having an associated bolt, the proximal portion of the upper plate having the upper internal right side short hinge and upper internal left side short hinge coupled thereto by the associated bolts of the proximal portion of the upper plate.

5. The parallelogram jack plate as described in claim 4, with the parallelogram jack plate further comprising each of the four rigid mount open hinged portion has an internal surface and an external surface, the internal surface of each of the four rigid mounts has open hinged portion having an outer stop and an inner stop with a curved surface there between forming the bushing seat.

6. The parallelogram jack plate as described in claim 5, with the parallelogram jack plate further comprising the rounded hook portion of each of the four rigid mounts having a distal enlargement and an internal recess with the internal recess being located between the distal enlargement and the rounded hook portion of each of the four rigid mounts.

7. The parallelogram jack plate as described in claim 6, with the parallelogram jack plate further comprising the upper plate central portion having a plurality of taper shaped holes there through.

8. The parallelogram jack plate as described in claim 7, with the parallelogram jack plate further comprising a pair of accessory mounting plates having an L-shaped configuration, each of the pair of accessory mounting plates having bolt holes there through, each of the accessory mounting plates being coupled to the motor mount plate.

9. The parallelogram jack plate as described in claim 8, with the parallelogram jack plate further comprising a plurality of backing plates, each backing plate having a rectilinear configuration with a forward surface and a rearward surface with a thickness there between, each of the plurality of backing plates having a pair of bolt holes there through, the backing plates being used to reinforce attachment of the parallelogram jack plate to a hull of an existing boat.

10. A parallelogram jack plate, comprising, in combination:

four rigid mounts being an upper transom mount and a lower transom mount and a lower distal mount and an upper distal mount, each of the four rigid mounts having a bushing seat therein;

four rigid mount bushings having an inner surface, the inner surface of each of the rigid mount bushings having a helical fluting therein;

a pair of long internal hinges having a curved external surface and a curved internal surface with the curved internal surface of the proximal portion of each of the pair of internal long hinges having a proximal stop and a distal stop with a curved there between forming a long internal hinge bushing seat;

a pair of long internal hinge bushings with each of the long internal hinge bushings having an inner surface with the inner surface of each of the long internal hinge bushings having a helical fluting therein;

a pair of short hinge assemblies, the short hinge assemblies each having an internal surface with the internal surface of each short hinge assembly having a proximal stop and a distal stop with a curved bushing surface there between;

four short hinge bushings having an internal surface with the internal surface of each of the four short hinge bushings having a helical fluting therein;

the middle internal short hinge of each of the internal short hinge assemblies having a proximal hook portion and a distal hook portion forming a curved bushing surface there between;

a pair of middle internal short hinge bushings having an inner surface with the inner surface of each of the middle internal short hinge bushings having a helical fluting therein;

a lower plate having a plurality of bolt holes there through with associated bolts, the lower plate being coupled to one of the pair of short hinge assemblies;

a sacrificial anode being removably coupled to the lower plate;

an upper plate having a plurality of bolt holes there through, the upper plate being coupled to one of the pair of short hinge assemblies, the upper plate also being coupled to one of the pair of internal long hinges, with the one of a pair of internal long hinges being coupled to the upper transom mount;

a motor mount plate having a plurality of bolt holes there through with a plurality of associated upper distal rigid mount bolts, the top portion of the motor mount plate being coupled to the upper distal rigid mount, the bottom portion of the motor mount plate being coupled to the lower distal rigid mount, the upper distal short hinge assembly being rotatably coupled to the upper distal rigid mount, the lower distal internal long hinge being coupled to the bottom portion of the motor mount plate, the lower distal internal long hinge being rotatably coupled to the lower distal mount;

a bi directional hydraulic cylinder having an upper end and a lower end, the bi directional hydraulic cylinder having an interior surface and an exterior surface, the length of the hydraulic cylinder having a centrally located piston passageway there through forming the interior surface, the hydraulic cylinder upper end interior surface having at least one snap ring groove therein, the hydraulic cylinder having a ram with an upper end and a lower end, the hydraulic cylinder having a bottom cap and a top cap, the hydraulic cylinder lower end having the bottom cap with the bottom cap having a plurality of circumferential recesses therein, the hydraulic cylinder bottom cap having a slot running from a median portion to a bottom end, the hydraulic cylinder bottom cap having a pin hole running through the median portion with the pin hole being orthogonal to the slot, and running across the slot, the pin hole having an associated pin, the slot being configured to receive and mate with the proximal portion of one of the internal short hinge assemblies middle short hinges with the bottom cap mounting bolt coupling the proximal lower internal short hinge assembly middle short hinge to the bottom cap of the hydraulic cylinder;

the bi directional hydraulic cylinder ram upper end having an associated top shaft cap, the hydraulic cylinder ram upper end top shaft cap having a trapazoidal configuration with an upper extent and a lower extent and two sides there between, the upper extent having a slot there in, the lower extent having a round recess therein so as to mate with and receive the hydraulic cylinder ram upper end, the ram upper end top shaft cap upper extent being configured to mate with and receive the proximal portion of a middle internal short hinge of the internal short hinge assemblies with the associated lower cap mounting bolt being used to couple the proximal portion of one of the internal short hinge assemblies middle short hinge to the upper end of the ram upper end top shaft cap;

the bi directional hydraulic cylinder upper end having a top cap, the hydraulic cylinder upper end top cap having a cylindrical configuration and the hydraulic cylinder top cap is sized to be sit into the hydraulic cylinder interior surface, the hydraulic cylinder top cap having a ram hole there through, the hydraulic cylinder upper end top cap having a plurality of grooves there in with the hydraulic cylinder upper end top cap plurality of grooves having at least one snap ring and at least one o-ring, the top cap being permanently fixed within the hydraulic cylinder interior surface once it is inserted into the centrally located piston passageway of the hydraulic cylinder;

a plurality of bracket caps, each of the bracket caps having a grease fitting hole there through, with each grease fitting hole of each of the bracket caps having an associated grease fitting; and a hydraulic fluid source and hydraulic fluid source control with the hydraulic fluid source and the hydraulic fluid source control being operatively coupled to the hydraulic cylinder.

11. A parallelogram jack plate, comprising, in combination:

a bidirectional hydraulic cylinder having an external surface and an internal surface with a length there between, the internal surface being a smooth constant internal diameter with an upper end and a lower end, with the upper end and the lower end of the hydraulic cylinder each having a snap ring groove therein, the hydraulic cylinder having a pair of threaded fluid passageway holes there through; and the bidirectional hydraulic cylinder having an associated top end cap and bottom end cap, the bottom end cap having a plurality of circumferential recesses therein being a snap ring groove and an oil seal ring groove and two o-ring grooves, the hydraulic cylinder bottom cap having a slot running from a median portion of the bottom end cap to a bottom end of the bottom end cap, the hydraulic cylinder bottom end cap having a pin hole running through the median portion, with the pin hole being orthogonal to the slot with the bottom cap pin hole running across the slot, the bottom cap pin hole having an associated pin, the upper end of the bottom end cap having a dual purpose hole which serves as an indexing hole, thereby preventing any rotation of the bottom cap, and the dual purpose hole comprising an access port for a hydraulic fluid fitting.

12. The parallelogram jack plate as described in claim 11, with the parallelogram jack plate further comprising:

The hydraulic cylinder comprising a ram with the ram having an upper end and a lower end with a length there between, the hydraulic cylinder comprising a ram upper end top shaft cap, the hydraulic cylinder ram upper end top shaft cap having a trapazoidal configuration, with an upper extent and a lower extent and two sides there between, the upper extent having a slot there in; and the lower extent of the ram upper end top shaft cap having a round recess therein to mate with and receive the hydraulic cylinder ram upper end, the top shaft cap having an associated mounting bolt.

13. The parallelogram jack plate as described in claim 12, with the parallelogram jack plate further comprising:

the hydraulic cylinder upper end top cap having a cylindrical configuration, with a ram hole there through, the hydraulic cylinder upper end top cap has a smooth interior surface and an exterior surface, the hydraulic cylinder upper end top cap exterior surface having a plurality of grooves there in, with the hydraulic cylinder upper end top cap plurality of grooves having at least one snap ring groove and at least one o-ring groove, the hydraulic cylinder upper end top cap exterior surface has a dual purpose hole therein, which serves as an indexing hole, thereby preventing any rotation of the upper end top cap, and an access port for a hydraulic fluid fitting, the top cap is configured to be permanently fixed within the hydraulic cylinder piston passageway once it is inserted into the centrally located piston passageway of the hydraulic cylinder.

* * * * *